US007731197B2

(12) United States Patent
Stutz

(10) Patent No.: US 7,731,197 B2
(45) Date of Patent: Jun. 8, 2010

(54) AUTOMATIC RESET TARGET PLATE RACK

(76) Inventor: Greg L. Stutz, 9656 E. 5th St., Tucson, AZ (US) 85748

( * ) Notice: Subject to any disclaimer, the term of this patent is extended or adjusted under 35 U.S.C. 154(b) by 1294 days.

(21) Appl. No.: 10/978,201

(22) Filed: Oct. 29, 2004

(65) Prior Publication Data

US 2005/0098954 A1 May 12, 2005

Related U.S. Application Data

(60) Provisional application No. 60/517,674, filed on Nov. 6, 2003.

(51) Int. Cl.
*F41J 5/14* (2006.01)

(52) U.S. Cl. ..... 273/392

(58) Field of Classification Search ..... 273/390–392, 273/403–410

See application file for complete search history.

(56) References Cited

U.S. PATENT DOCUMENTS

| | | | | | |
|---|---|---|---|---|---|
| 1,098,255 | A * | 5/1914 | Harper | 273/392 |
| 1,865,988 | A * | 7/1932 | Wiedeck | 273/385 |
| 2,561,733 | A | 7/1951 | Foyst | 273/102 |
| 3,844,559 | A * | 10/1974 | Davidson et al. | 273/383 |
| 4,550,918 | A * | 11/1985 | Motsenbocker | 273/385 |
| 4,588,194 | A | 5/1986 | Steidle et al. | 273/391 |
| 4,714,256 | A | 12/1987 | Mosser | 273/392 |
| 4,739,996 | A | 4/1988 | Vedder | 273/392 |
| 4,917,388 | A | 4/1990 | Marquardt | 273/392 |
| 4,949,980 | A | 8/1990 | Hoy | 273/391 |
| 4,979,752 | A | 12/1990 | Fosseen | 273/392 |
| 5,263,722 | A | 11/1993 | Rosellen | 273/391 |
| 5,324,043 | A * | 6/1994 | Estrella | 273/392 |
| 5,342,062 | A | 8/1994 | Lance | 273/391 |
| 5,346,226 | A | 9/1994 | Block | 273/388 |
| 6,347,798 | B1 | 2/2002 | Quiring et al. | 273/391 |
| 6,502,820 | B2 | 1/2003 | Slifko | 273/391 |
| 6,808,177 | B2 * | 10/2004 | Dehart | 273/406 |
| 2004/0195775 | A1 * | 10/2004 | Goldsmith, Jr. | 273/392 |

OTHER PUBLICATIONS

"Targets" article off of http://www.birchwoodcasey.com/sport/targets/index.asp?menu=10 Sep. 23, 2003.

(Continued)

*Primary Examiner*—Mark S Graham
(74) *Attorney, Agent, or Firm*—Mendelsohn, Drucker, & Assoc., P.C.; Kevin M. Drucker

(57) ABSTRACT

An automatic reset target plate rack has a plurality of target plates and latches, a reset plate, and a reset mechanism. In operation, the user strikes one or more of the target plates, which travel rearward and are captured by the latches, and the user next strikes the reset plate to activate the reset mechanism and free the captured target plates, returning them to their upright position. In one aspect, a target plate rack consistent with the invention includes a target plate pivoting on a first axis; and a latch pivoting on a second axis. The latch is positioned to contact and capture the target plate when the target plate is pivoted to a predetermined rotational position. In another aspect, a target plate rack consistent with the invention includes a target plate pivotally disposed on a pivot rod and biased toward a first predetermined rotational position.

21 Claims, 23 Drawing Sheets

OTHER PUBLICATIONS

Target information off of www.bluelight.com, Sep. 23, 2003.
Article form www.gunshed.com regarding the SharpShooter (.22), Sep. 23, 2003.
Article form Law Inforcement Targes, Inc., from www.letargets.com, Sep. 23, 2003.
"Automated Reset Targets" information found on www.metaltargets.com/ResetTarges.htm, Sep. 23, 2003.
"New Targets" information found on www.metaltarges.com/NewTargets.htm.

* cited by examiner

FIG. 10
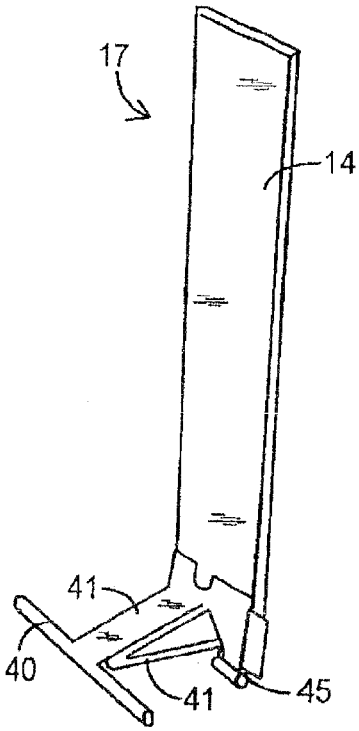
FIG. 11
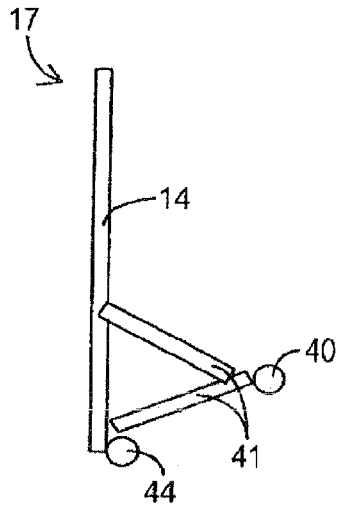
FIG. 12
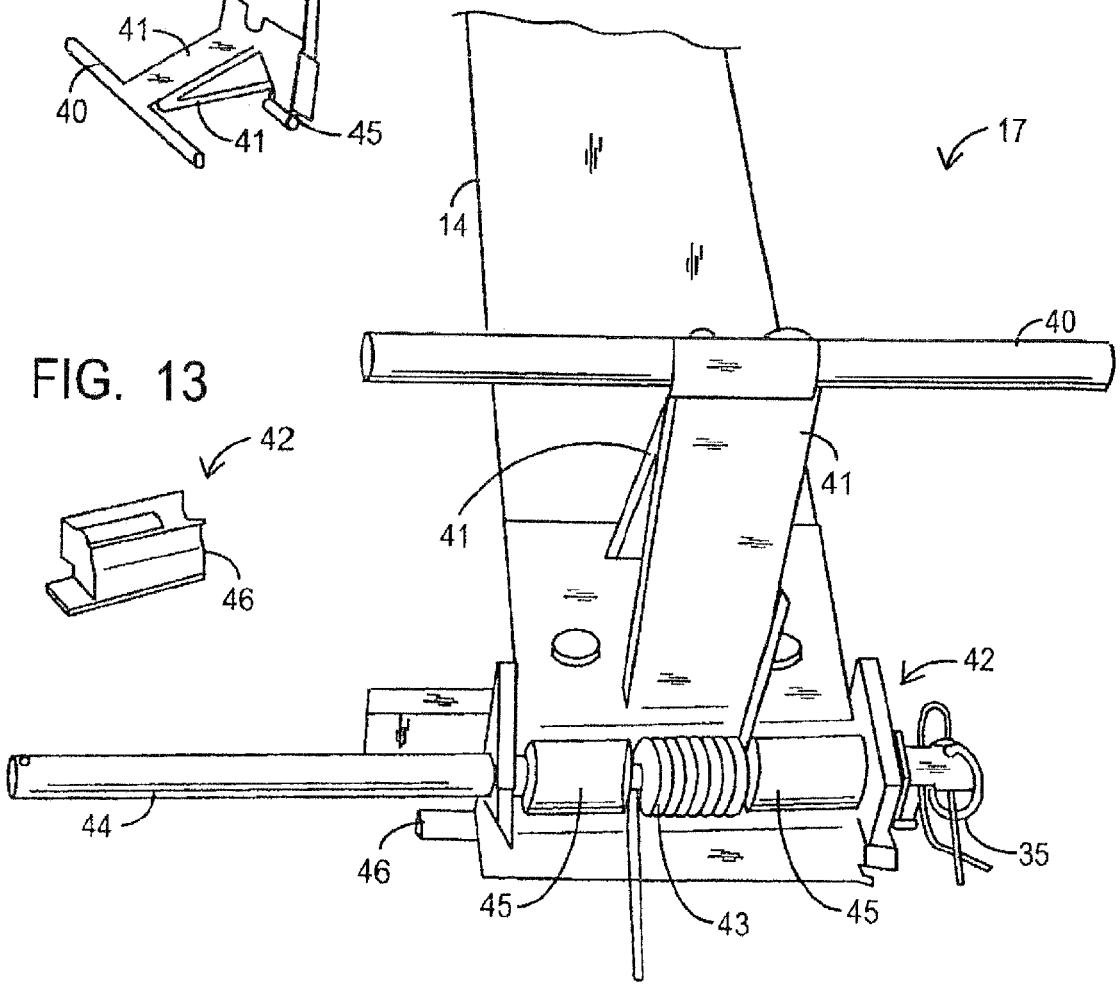
FIG. 13

AUTOMATIC RESET TARGET PLATE RACK

CROSS-REFERENCE TO RELATED APPLICATION

This application claims priority to U.S. Provisional Patent Application Ser. No. 60/517,674, entitled "Automatic Reset Target Plate Rack," filed Nov. 6, 2003, the disclosure of which is incorporated herein by reference in its entirety.

BACKGROUND OF THE INVENTION

The present invention relates generally to firearms, and more particularly, to automatically-resettable target plate rack assemblies.

Target shooting with rifles, pistols and firearms is a common sport, hobby and pastime, and target shooting also develops critical skills for police and military personnel. Permanent and portable target structures having target plates are commonly used to determine the point of impact of the projectile and accuracy of the aim of the shooter.

Traditionally, targets were typically designed hinged to a supporting structure so as to fall when struck by a projectile. The target would then be lifted either mechanically or manually into its ready position. The problem with this type of target is that every time the target is struck it must be manually reset, which, among other disadvantages, placed the target-setter at risk of injury from stray shots fired at nearby targets.

To prevent the continuous resetting of a single target, a multitude of such targets were set up for use by a single shooter. Previous targets were thus costly in that a shooting range would be required to have many targets available for target practice. Further, someone would need to reset the multitude of targets, which requires additional time from the shooter.

Automatically-resettable target plate racks attempted to solve this problem by either changing the target somehow, or by moving the target to a non-target position, upon impact with a projectile. However, the target still required resetting or a return to the target position before shooting could continue.

As described in U.S. Pat. No. 5,342,062 to Lance, U.S. Pat. No. 4,588,194 to Steidle et al., and U.S. Pat. No. 2,561,733 to Foyst, other prior art target plate racks require resetting using a string or other pull-type mechanism, which suscept the mechanism to damage and wear from "splatter," i.e. fragments of projectiles striking the target plates.

As U.S. Pat. No. 4,739,996 to Vedder discloses, battery-operated motorized reset mechanisms are also known, but these suffer from the aforementioned deficiencies due to "splatter," as well as the necessity for periodic battery replacement and that potential deterioration of sensitive electronic components. U.S. Pat. No. 4,979,752 to Fosseen teaches an automatically resetting target that employs a computer-actuated valve to supply compressed air from a cylinder, which is used to reset the target upon detection by the computer, via a magnetic reed switch, that the target was knocked down. However, this configuration is costly, requires periodic replacement of empty cylinders, and increases the risk that sensitive electronic components will fail.

Other automatically-resettable target plate racks include mechanisms that allow the individual targets to swing and move when struck by a projectile indicating a successful shot, yet pivot back into position or swing back into position for another shot. These devices also have notable drawbacks. First, the targets are arranged side-by-side such that they require the shooter to move his or her line of fire from side-to-side to hit the target. Moreover, the shooter must wait for the target to stop swinging and properly align itself before taking another shot. This does not lend itself to practice of rapid fire marksmanship.

One example of such a device is disclosed in U.S. Pat. No. 4,917,388 to Marquart, which discloses a self-resetting target that hangs from a frame. When struck, the target pivots about a hinge and abuts a stop to limit its pivotal movement, then automatically pivots back into place under the force of gravity to be ready for the next shot. In addition to the aforementioned deficiencies, this configuration additionally does not permit a plurality of targets to be knocked down before they are all reset in tandem, since a single target is shot, then the shooter waits for it to reset itself, then the target is shot again, then the shooter waits for it to reset itself, etc., and thus, the shooter cannot tell whether or not a target was shot by glancing at the stationary assembly, except immediately upon firing the shot.

Another example is U.S. Pat. No. 4,714,256 to Mosser, which discloses a target assembly including an upright silhouette hinged to a base connected to a stake anchored in the ground. An anchor remote from the target is connected to the target, with an elongated flexible line containing a biasing spring, which biases the silhouette in a generally upright position, such that when hit, the silhouette returns to the upright position. This configuration suffers from the aforementioned "splatter" problem, as well as the inability for the shooter to know whether the target was actually hit, except immediately after firing the shot.

U.S. Pat. No. 5,346,226 to Block discloses a resetting target assembly that includes a pair of targets cooperatively connected by a linkage so that the falling of the first target, when struck by a projectile, raises the second target from a horizontal to a vertical position, and the falling of the second target, when struck by a projectile, raises the first target from a horizontal to a vertical position. This configuration, however, only allows for two targets and does not permit more than two targets to be knocked down before they are all are reset in tandem.

U.S. Pat. No. 6,347,798 to Quiring et al. discloses an automatic reset target having an upright frame connected to a stand for supporting the target on a surface, and a plurality of target arms having target pads that swing on a rod secured to the frame between down target positions to neutral out-of-sight non-target positions when the target pads are hit with projectiles. A trigger arm pivotally mounted on the frame has a target arm holding member which retains the target arms and pads in the neutral out-of-sight non-target positions. A trigger arm pad on the upper end of the trigger arm when hit with a projectile swings the trigger arm in a direction to move the target arm holding member out of engagement with target arms and pads to allow the target arms and pads to return to their down target positions. Among other drawbacks, this configuration requires a plurality of target pads that hang downward, providing a visually cluttered target area, as well as suffering from the aforementioned "splatter" problem. Further, each target pad is mounted on an arm, and this two-piece construction increases the risk of damage and the necessity for frequent parts replacement.

U.S. Pat. No. 4,949,980 to Hoy discloses a target array including a multiplicity of upright target assemblies. When an upright first target is struck by a projectile, the target pivots to a knocked down position and its stem is held down by a latch. A second depending reset target when struck by a projectile moves to unlatch the stem of the knocked down target, which returns to the upright position. Since each target is mounted on a narrower stem, this two-piece construction increases the risk of damage and the necessity for frequent parts replacement. Additionally, there is no adjustability of target resistance to accommodate various ranges and calibers of rounds, and a fixed minimum level of projectile velocity is required for activation.

U.S. Pat. No. 6,502,820 to Slifko discloses a multiple target apparatus having an array of target plates arrayed linearly and pivotally on a first elongate shaft, wherein a plurality of torsion providing components located on the first shaft are adapted to bias the targets in an upright mode, with a target having a depending arm pinned to rotate upon the imposed deflection of a target by a speeding projectile to a latching position. Arrayed upon a spaced apart, second shaft are a like number of rigid levers spanning the lateral space between the first and second shafts. A detent on the one end of each of the depending arms is adapted to be contacted and arrested by the opposing lever until such are dislodged by a discrete target deflection and array reset, which are located at one end of the device, such that upon imposed rotation of the reset means, it also releases the latching position of the other targets. Just as in the case of the two-piece stem and target construction disclosed in the Hoy patent described above, the construction of each target in the Slifko patent requires a three-piece construction of support collar, depending arm, and target plate, which increases the risk of damage and the necessity for frequent parts replacement, as well as increasing the cost of manufacture by necessitating a complex plurality of parts in the assembly.

U.S. Pat. No. 5,263,722 to Rosellen discloses another resettable target, wherein the single reset target is aligned diametrically opposite from the main target array, rather than aligned with the array. Moreover, the latching and reset linkages are quite complex and are gravity-dependent and therefore operable only in the mode depicted. As is the case with the Hoy patent described above, in the Rosellen patent each target is mounted on a narrower stem, and this two-piece construction increases the risk of damage and the necessity for frequent parts replacement. Additionally, there is no adjustability of target resistance to accommodate various ranges and calibers of rounds.

Thus, there is a demonstrated need for an automatically-resettable target plate rack that overcomes the deficiencies of the prior art.

SUMMARY OF THE INVENTION

The present invention solves the problems of the prior art by providing an automatic reset target plate rack that has a plurality of target plates and a reset plate. In operation, the user can strike one or more of the target plates, which travel rearward and are contacted and captured by latches. To reset the captured target plates, the user simply strikes the reset plate, which activates a reset mechanism, thereby freeing the captured target plates and returning them to their upright position.

In one aspect, a target plate rack consistent with the invention includes a target plate pivoting on a first axis; and a latch pivoting on a second axis. The latch is positioned to contact and capture the target plate when the target plate is pivoted to a predetermined rotational position. The target plate rack may have a distalmost end with respect to the second axis, wherein the latch is positioned to contact and capture the target plate at or near its distalmost end. The target plate rack may further include a device mechanically coupled to the target plate and biasing the target plate to pivot toward a second predetermined rotational position. The device mechanically coupled to the target plate may be a spring under tension, and the target plate rack may further include an adjustment mechanism for altering the tension of the spring. The target plate rack may further include a release arm movable from a first position to a second position, the release arm positioned to contact the latch when moved from the first position to the second position and cause the latch to pivot in a predetermined rotational direction, thereby releasing the captured target plate. The target plate rack may further include a reset plate rotating on a third axis, the reset plate mechanically coupled to the latch and positioned to cause the latch to pivot in a predetermined rotational direction when the reset plate pivots to a predetermined rotational position, thereby releasing the captured target plate. The third axis may be substantially coaxial with the second axis. At least a portion of at least one of the target plate and the latch may include armor plating.

In another aspect, a target plate rack consistent with the invention includes a latch having an aperture formed therein and a generally L-shaped hook portion extending therefrom. The hook portion may have a bevel formed thereon and may have a recess formed therein. The aperture may be substantially rectangular or substantially cross-shaped. At least a portion of the latch may include armor plating.

In a further aspect, a target plate rack consistent with the invention includes a reset plate pivoting on a first axis, a linking element, a first bracket mechanically coupled to the reset plate, the first bracket pivoting on the first axis and being pivotally coupled to the linking element on a second axis, and a second bracket pivotally coupled to the linking element on a third axis, wherein the second bracket pivots on the third axis in a first predetermined rotational direction when the reset plate pivots on the first axis in a second predetermined rotational direction. The first predetermined rotational direction may be the same as the second predetermined rotational direction. The second bracket may further pivot on a fourth axis. The target plate rack may further include a sleeve pivotally coupled to at least one bracket, the sleeve receiving and supporting the linking element therein. At least one bracket may have a plurality of height adjustment holes formed therein. The second bracket may be generally L-shaped. At least a portion of the reset plate may include armor plating.

In yet another aspect, a target plate rack consistent with the invention includes a target plate pivoting on a first axis and biased to pivot toward a predetermined rotational position, a detachable reset plate, and a detachable reset assembly, wherein the reset plate and reset assembly are adapted to be installed in the target plate rack with the reset plate biased either to pivot toward the same predetermined rotational position as the target plate, or toward a rotational position 180 degrees from the predetermined rotational position of the target plate.

In yet a further aspect, a target plate rack consistent with the invention includes a frame having left and right sides, the frame including a plurality of latch mounts aligned on a first axis, each latch mount positioned to retain a latch that pivots on the first axis, a latch retained by one of the latch mounts, and a target plate pivot rod substantially disposed between the left and right sides of the frame, the rod disposed on a second axis. The target plate rack may further include a target plate pivotally disposed on the target plate pivot rod. The target plate rack may further include a release arm mechanically coupled to the left and right sides of the frame and pivoting on a third axis, the release arm movable from a first position to a second position and positioned to contact the latch when moved from the first position to the second position and cause the latch to pivot in a predetermined rotational direction. The target plate rack may further include a first bracket pivoting on the second axis, and a second bracket retained by one of the latch mounts, the second bracket being mechanically coupled to the first bracket and pivoting on the first axis, wherein the second bracket pivots on the first axis in a first predetermined rotational direction when the first bracket pivots on the second axis in a second predetermined rotational direction. The first predetermined rotational direction may be the same as the second predetermined rotational direction. The second bracket may be generally L-shaped. The target plate rack may further include at least one leg or leg mount. The target plate rack may further include at least one wheel coupled to the frame, and at least one handle coupled to the frame, wherein the handle and wheel are positioned to permit a user to support the target plate rack on the wheel and to roll the target plate rack, using the handle to push and/or guide the travel path of the target plate rack. The target plate rack may further include a shield including armor plating, the shield covering at least a portion of the target plate rack. The target plate rack may further include at least one device or mating feature formed therein or thereon for coupling the target plate rack to another target plate rack. The target plate rack may further include a target plate pivotally disposed on the target plate pivot rod and biased toward a first predetermined rotational position, wherein the latch is positioned to contact and capture the target plate when the target plate is pivoted to a second predetermined rotational position, a reset plate pivotally disposed on the target plate pivot rod, and a reset assembly mechanically coupled to the reset plate and to the latch, the reset assembly positioned to cause the latch to release the captured target plate when the reset plate pivots to a third predetermined rotational position, thereby returning the captured target plate to the first predetermined rotational position. At least a portion of at least one of the target plate, latch, latch mount and frame may include armor plating.

In still another aspect, a target plate rack consistent with the invention includes a target plate pivotally disposed on a pivot rod and biased toward a first predetermined rotational position, a latch positioned to contact and capture the target plate when the target plate is pivoted to a second predetermined rotational position, and a reset plate pivotally disposed on the pivot rod, the reset plate positioned to mechanically engage the latch to release the captured target plate when the reset plate pivots to a third predetermined rotational position, thereby returning the captured target plate to the first predetermined rotational position. At least a portion of at least one of the target plate, latch, and reset plate may include armor plating.

In still a further aspect, a target plate rack consistent with the invention includes at least one target plate having height and width dimensions, wherein the ratio of height to width is approximately 2.5:1. The height may be approximately 10 inches, and the width may be approximately 4 inches. The target plate may have a thickness of approximately 0.375 inches. The target plate may be generally rectangular or tombstone-shaped, or at least a portion of the target plate may be generally at least partially circular. At least two mounting holes may be formed in the target plate, the mounting holes being spaced approximately 2.5 inches apart. At least one central aperture may be formed in the target plate for reducing the mass or weight of the target plate. The target plate rack may further include vibration damping material disposed on at least a portion of the target plate. The target plate rack may further include a target plate mount coupled to the target plate, wherein the target plate mount and the target plate are pivotally disposed in tandem on an axis. The target plate mount may include at least one sleeve generally coaxial with the axis. At least two mounting holes may be formed in the target plate mount, the mounting holes being spaced approximately 2.5 inches apart. The target plate rack may further include vibration damping material disposed between at least a portion of the target plate and the target plate mount. The target plate rack may further include at least one fastener coupling the target plate mount to the target plate. At least a portion of the target plate may include armor plating.

In another aspect, a target plate rack consistent with the invention includes a target plate mount pivotally disposed on an axis, the target plate mount including at least one sleeve generally coaxial with the axis. At least two mounting holes may be formed in the target plate mount, the mounting holes being spaced approximately 2.5 inches apart. The target plate rack may further include vibration damping material disposed on at least a portion of the target plate mount. At least a portion of the target plate mount may include mild steel.

In yet another aspect, a method of knocking down and resetting a target in a target plate rack includes: pivotally disposing a first plate on a first axis and biasing the first plate toward a first predetermined rotational position, the first plate having a distalmost end with respect to the first axis; capturing the first plate at or near the distalmost end when the first plate is pivoted to a second predetermined rotational position; and releasing the captured target plate and returning the captured target plate to the first predetermined rotational position when a second plate pivots to a third predetermined rotational position.

BRIEF DESCRIPTION OF THE DRAWINGS

FIG. 10 is a side perspective view of an exemplary reset assembly, in the automatic reset target plate rack assembly of FIG. 1;

FIG. 11 is a side elevational view of the exemplary reset assembly of FIG. 10;

FIG. 12 is a more detailed perspective view of the lower end of the exemplary reset assembly of FIG. 10;

FIG. 13 is a perspective view of an exemplary reset mount, in the automatic reset target plate rack assembly of FIG. 1;

DETAILED DESCRIPTION OF THE EMBODIMENTS

Figure 1:
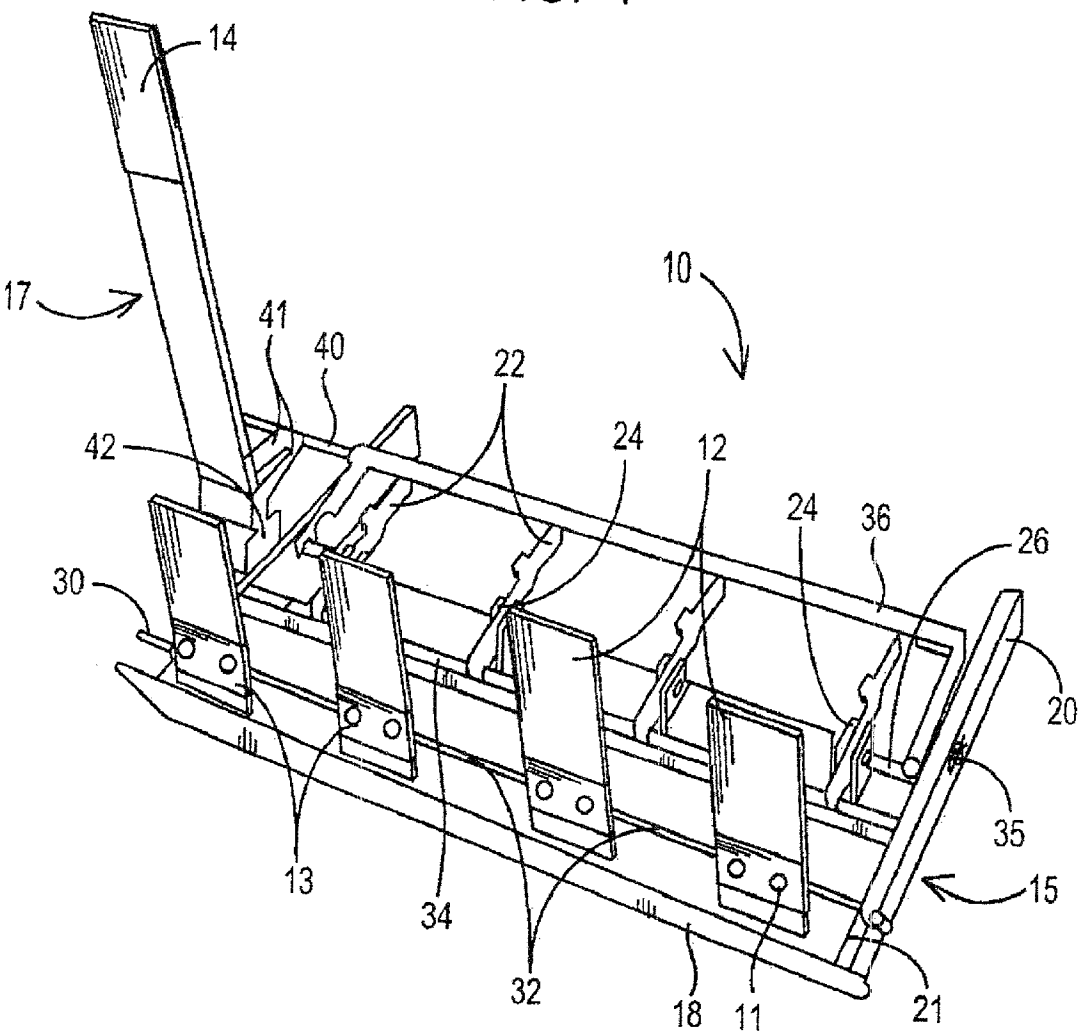
FIG. 1 is a front perspective view of a fully-assembled exemplary automatic reset target plate rack assembly consistent with the present invention.
Figure 2:
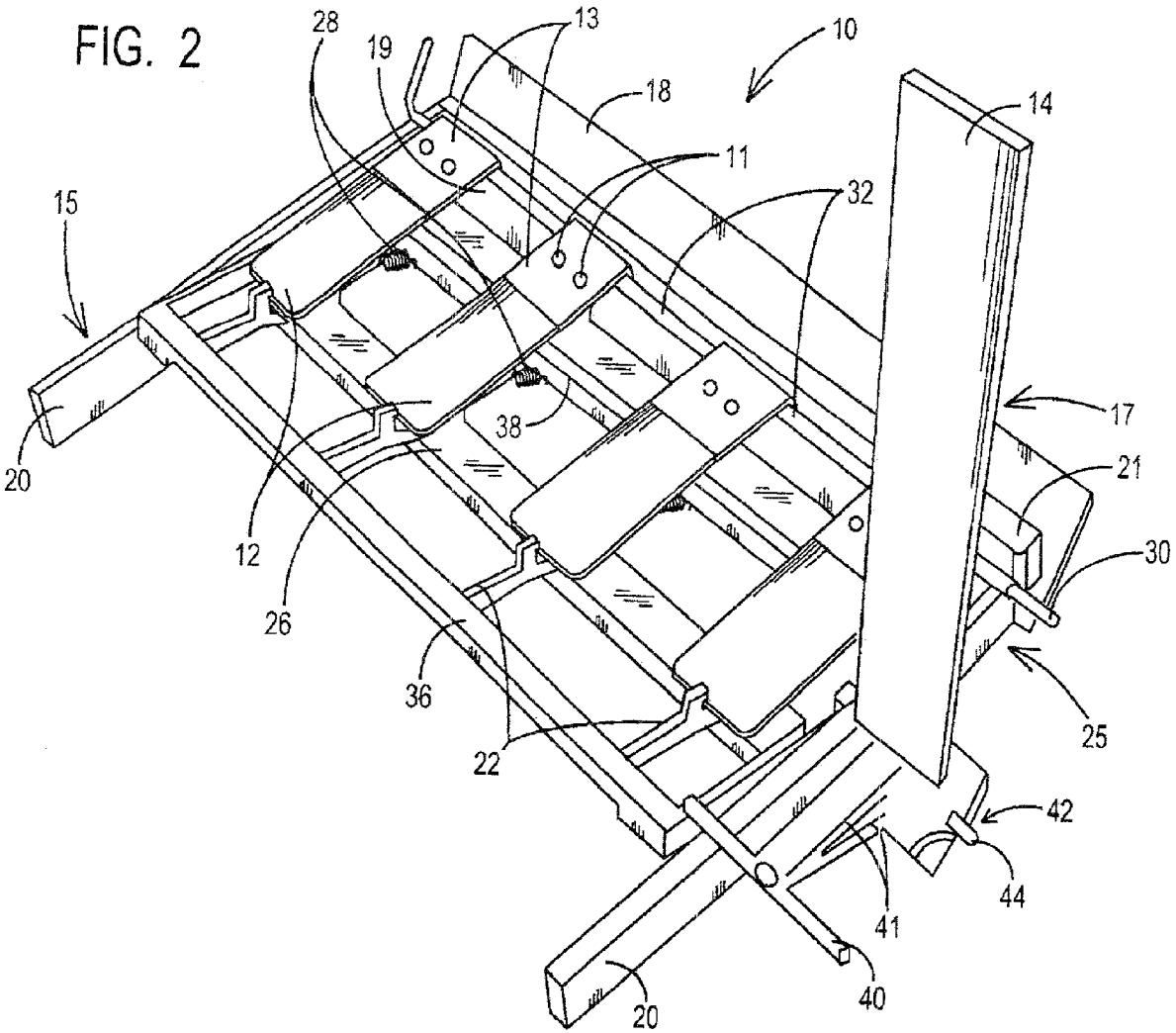
FIG. 2 is a rear perspective view of the automatic reset target plate rack assembly of FIG. 1.

Turning first to FIGS. 1 and 2, front and rear perspective views of a fully-assembled exemplary automatic reset target plate rack assembly 10 consistent with the present invention are respectively illustrated.

As shown in FIGS. 1 and 2, the assembly 10 includes a three-sided frame 15 for holding a plurality of target plates 12 and a reset assembly 17. The frame 15, which may be constructed, e.g., from mild steel, includes a front rail 19 and a pair of parallel side rails 20, all of which may serve both to stabilize the assembly 10 when the assembly rests on a flat surface, such as the ground, and to permit attachment of many of the components of the assembly 10.

Mounted (e.g., by welding) to the front rail 19 of the frame 15 are a front armor shield 18 and a shelf 21, both of which are desirably constructed from a hard, dense material, such as AR-500 armor plating. The front armor shield 18 should be large enough to withstand the vibrations and forces of impact of direct hits by projectiles. The front armor shield 18 is angled downward, such that a projectile striking the shield 18 is deflected toward the ground, and the shield 18 is disposed so as to protect the components of the assembly 10 located behind the shield 18 from direct hits by projectiles.

The shelf 21 is disposed so as to protect the front rail 19 from "splatter." In the embodiment shown, there are four rectangular target plates 12 (although numbers of target plates other than four and target shapes other than rectangular may, of course, be provided), which also are desirably constructed from a hard, dense material, such as AR-500 armor plating.

Each of the target plates 12 is mounted on a respective target plate mount 13 by means of, e.g., a pair of grade 8 bolts 11 disposed through a pair of matching through holes (not visible in FIGS. 1 and 2) formed in the lower portions of the target plates 12 and target plate mounts 13. The bolts 11 are located below and behind the front armor shield 18 to prevent the heads of the bolts from being damaged by direct hits by projectiles. The target plate mount 13 may be formed from, e.g., mild steel.

Figure 3:
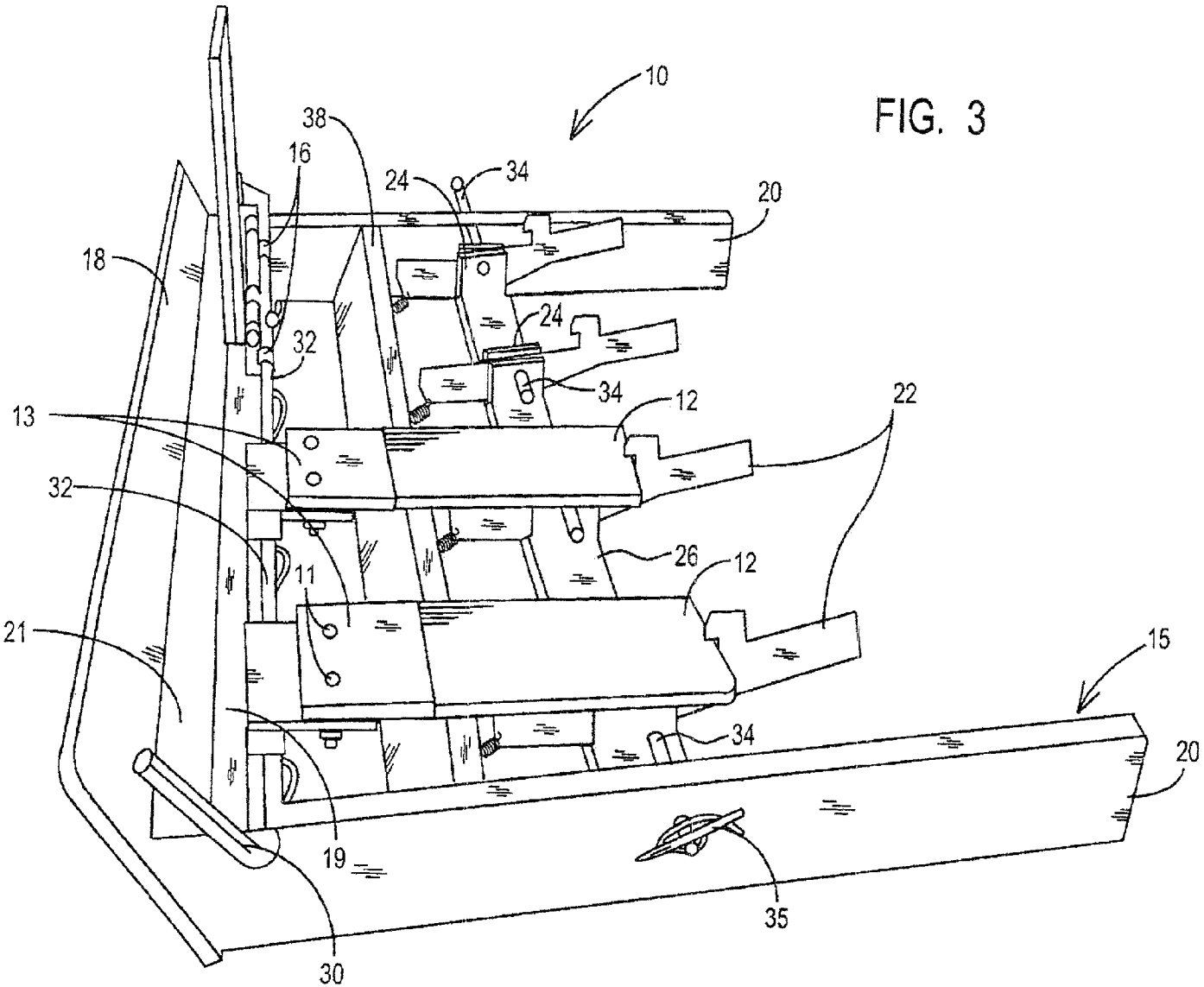
FIG. 3 is a side perspective view of the automatic reset target plate rack assembly of FIG. 1, shown without the reset assembly.

The configuration of the target plates 12 and target plate mounts 13 may best be seen in FIG. 3, which is a side perspective view of the exemplary automatic reset target plate rack assembly 10 of FIGS. 1 and 2, shown without the reset assembly 17. One or more (e.g., rubber) gaskets (not shown) may be disposed between the plate 12 and mount 13, and may be glued either to the plate 12, the mount 13, or both. This arrangement causes the plate 12 to "flex" slightly off of the mount 13, provide vibration damping, and subsequently reduces wear on the welds and joints of the assembly 10.

As illustrated in FIGS. 1-3, the target plate mounts 13 are rotatably disposed on a target plate pivot rod 30 such that the target plate mounts 13 and the attached target plates 12 rotate rearward and downward when struck from the front by a projectile. The target plate pivot rod 30, which may be formed, e.g., from cold rolled steel, is disposed through a plurality of target plate pivot sleeves 32 located (e.g. by welding) on the inner surface of the front rail 19 of the frame 15, as well as through pivot sleeves (not visible) located (e.g., by welding) on the rear surfaces of the target plate mounts 13. (The sleeves may best be seen in FIG. 4). In the exemplary embodiment shown, the target plate pivot rod 30 has an L-shaped bend at one end to permit the rod 30 to be grasped and wiggled back and forth for insertion or removal by a user with relative ease, e.g., to remove and/or replace the target plates 12, which are desirably modular, as will be explained in further detail hereinbelow. It should be understood that the single target plate pivot rod 30 described herein may alternatively be embodied as a plurality of shorter pivot rods individually retained by one or more pivot sleeves, with each shorter rod supporting one or more target plates 12.

Figure 9:
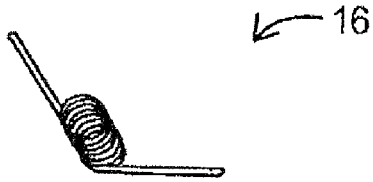
FIG. 9 is a perspective view of an exemplary target plate spring, in the automatic reset target plate rack assembly of FIG. 1.

A respective target plate spring 16 (which is illustrated individually in the perspective view of FIG. 9), located behind each of the target plate mounts 13, is wound around and rotatably disposed about the target plate pivot rod 30 and provides torque to the rear of the target plate mounts 13 and the attached target plates 12 sufficient to bias the target plate mounts 13 and the attached target plates 12 forward, in an upright position. Forward travel of the target plate mounts 13 is restricted by their abutment with the rear-facing surface of the front rail 19, and the target plates 12 are sized and shaped such that the bottom surfaces of the target plates 12 rest on the top surface of the shelf 21 when fully biased forward. Thus, when the target plates 12 are in an upright position, they are substantially orthogonal to the surface on which the assembly 10 is resting. It should be understood that devices other than springs 16 may be used to forwardly bias the target plates 12, e.g., wires, elastic bands, belts, or pulleys.

A respective latch 22 is provided for each of the target plates 12, to capture the respective plate 12 at the end of its rearward travel path after being struck from the front by a projectile. The latches 22 are desirably constructed from a hard, dense material, such as AR-500 armor plating to reduce wear caused by the "splatter" of projectile fragments, as well as to bear the impact of the AR-500 target plates 12 that repeatedly strike the latches 22 during normal use.

Figure 4:
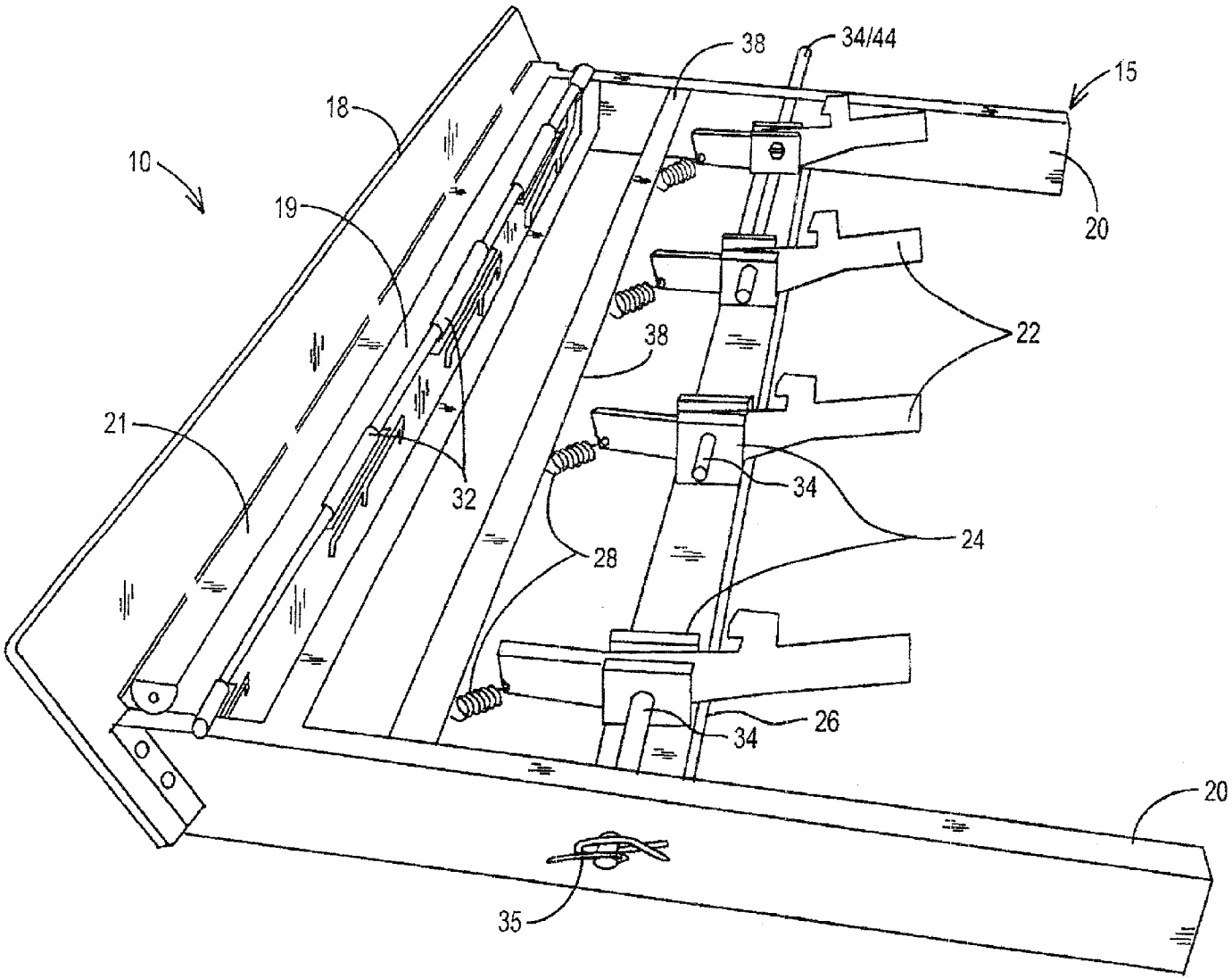
FIG. 4 is a side perspective view of the automatic reset target plate rack assembly of FIG. 1, shown without the reset assembly, target plate mounts, target plates, target plate pivot rod, and target plate springs.

With reference now to FIG. 4, which is a side perspective view of the exemplary automatic reset target plate rack assembly 10 of FIGS. 1 and 2, shown without the reset assembly 17, target plate mounts 13, target plates 12, target plate pivot rod 30, and target plate springs 16, the configuration of the latches 22 may best be seen. A latch mount crossbar 26 is disposed (e.g., by welding) between the side rails 20 of the frame 15, and a respective latch mount 24 is provided for each latch 22. Each of the latch mounts 24 is formed by a pair of parallel upward projections having substantially similarly sized through holes formed therein and a gap therebetween sufficient to accommodate the thickness of the latch 22. Each latch 22 is disposed between a respective pair of projections of each latch mount 24 and has a matching through hole formed therein, thereby permitting insertion of a latch pivot rod 34 through the latch 22 and the mount 24.

It should be noted that the use of a separate pivot rod 34 for each latch 22 permits the latches 22 to rotate fully independently of one another. Notwithstanding, while a respective individual latch pivot rod 34 is provided for each latch 22 in the embodiment shown, a single latch pivot rod 34 may alternatively be disposed through all (or some) of the latches 22. The latch pivot rods 34, which may be formed, e.g., from cold rolled steel, may be held in place laterally by means of one or more cotter pins 35 or similar restraining devices. The forward portion of each latch 22 is biased downward by means of a latch spring 28, one end of which attaches to the latch 22 (e.g., by means of a through hole appropriately sized with respect to the diameter of the wire at the end of the latch spring 28), and the other end of which attaches to a latch spring attachment shield 38 disposed (e.g., by welding) between the side rails 20 of the frame 15.

A latch spring attachment shield 38 (e.g., having a rectangular cross-section) disposed between the side rails 20 of the frame 15, is desirably constructed from a hard, dense material, such as AR-500 armor plating so as to protect the latch springs 28 from the "splatter" of projectile fragments striking the target plates 12 or other surfaces of the assembly 10.

With particular reference to the side elevational views of FIGS. 5 and 6, the design and operation of the latches 22 with respect to the target plates 12 will now be described. Each of the latches includes a generally L-shaped hook portion 48 having a beveled surface 49 and a recess 54 formed therein.

Figure 5:
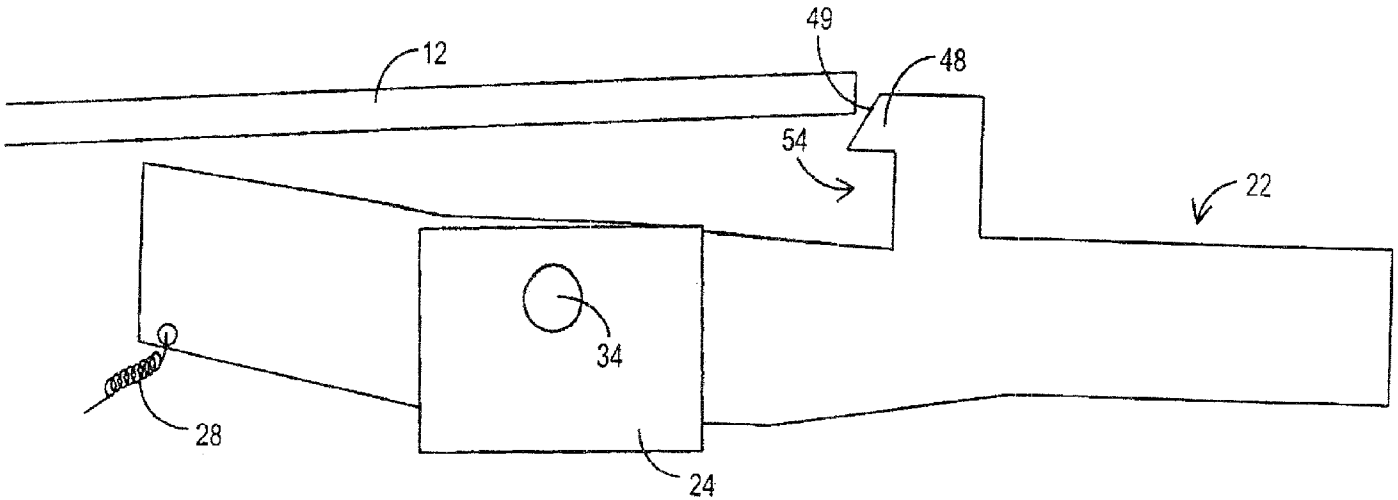
FIGS. 5 and 6 are side elevational views of the latch, latch mount, and target plate, in the automatic reset target plate rack assembly of FIG. 1.

As shown in FIG. 5, when a target plate 12 travels rearward after being struck from the front by a projectile, it contacts and travels downward along the beveled surface 49 of the hook portion 48 of the latch 22, causing the latch 22 to rotate in a direction against the tension of the latch spring 28 (i.e., clockwise, as viewed in FIGS. 5 and 6), until the target plate 12 travels beyond the hook portion 48 of the latch 22, whereby the target plate 12 is captured in the recess 54 of the latch 22. The foregoing manner of operation is typical when a low-caliber weapon is used. However, when a high-caliber weapon is used, the target plate 12 may strike the hook 48 with force sufficient to cause the latch 22 to over-travel.

Figure 6:
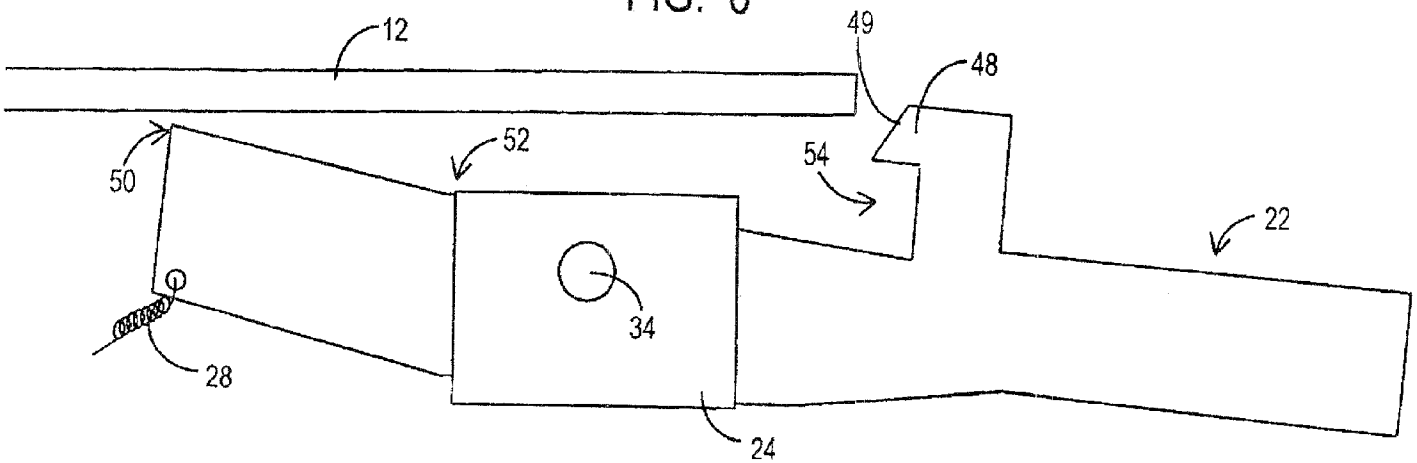

As shown in FIG. 6, when such over-travel occurs, the target plate 12 will strike a raised area on the upper surface of the latch 22, which serves as an over-travel contact area 50. When the target plate 12 strikes the over-travel contact area 50, the latch 22 is forced to change direction and rotate in the direction of tension of the latch spring 28 (i.e., counter-clockwise, as viewed in FIGS. 5 and 6), whereby the target plate 12 is captured in the recess 54 of the latch 22 when travel of the target plate 12 is prevented by the upper surface of the latch mount 24, which serves as an over-travel contact area 52.

Figure 7:
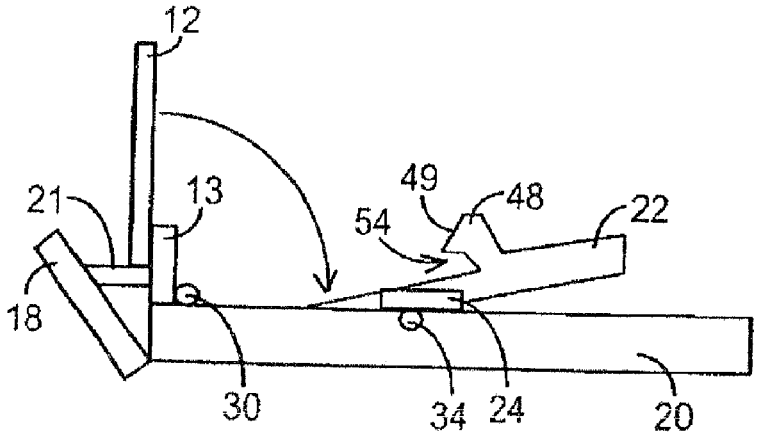
FIG. 7 is a side elevational view of an exemplary target plate in its fully forward-biased upright position, in the automatic reset target plate rack assembly of FIG. 1.
Figure 8:
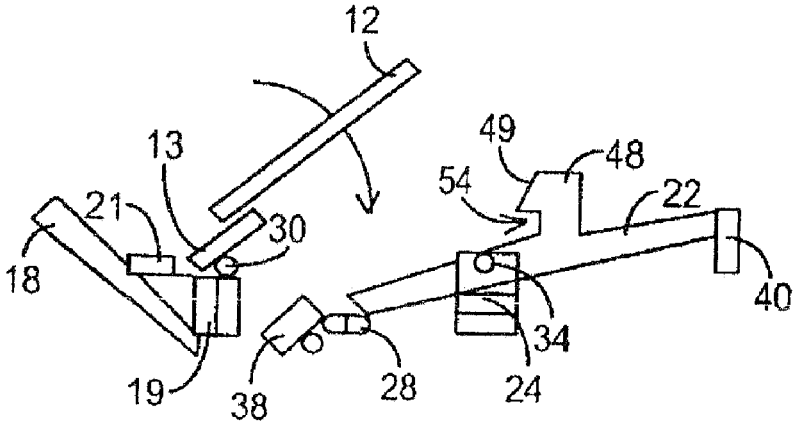
FIG. 8 is a side elevational view of an exemplary target plate during its rearward and downward travel path, in the automatic reset target plate rack assembly of FIG. 1.

The foregoing operation of the latches 22 with respect to the target plates 12 is additionally illustrated in the side elevational views of FIGS. 7 and 8, which respectively show one of the target plates 12 in its fully forward-biased upright position, and the target plate 12 during its rearward and downward travel path. It should be noted that, for clarity, the side views of FIGS. 7 and 8 are provided with the reset assembly 17 removed, and the sectional view of FIG. 8 is provided with one of the side rails 20 removed. As will be described in further detail hereinbelow with respect to the reset assembly 17, when sufficient downward pressure is placed on the rear portion of one of the latches 22 while the latch 22 is holding a target plate 12 captive, the target plate 12 is released from captivity and springs forward due to the forward bias of the latch spring 28, thereby returning the target plate 12 to its upright position.

Turning now to FIGS. 10-13, the structure and operation of the reset assembly 17 will now be described. As shown in the side perspective view of FIG. 10 and the side elevational view of FIG. 11, the reset assembly 17 includes an elongated reset plate 14, which is desirably constructed from a hard, dense material, such as AR-500 armor plating, since the top front surface of the reset plate 14 is designed to be struck by a projectile in order to reset the target plates 12 held captive by the latches 22. A pair of reset arm supports 41 are each attached (e.g., by welding) at one end thereof to the rear lower surface of the reset plate 14, forming a triangular shape, and a reset arm 40 is disposed (e.g., by welding) to the reset arm supports 41, at their outermost portions.

As is best seen in FIG. 12, which is a more detailed view of the lower end of the reset assembly 17, a pair of reset arm pivot sleeves 45 are disposed at the lower end of the reset plate 14, below the attachment points of the reset arm supports 41 thereon. A reset mount 42, illustrated in perspective view in FIG. 13, is disposed over the reset arm pivot sleeves 45, and a reset arm pivot rod 44 is disposed through the reset arm pivot sleeves 45. The reset arm pivot rod 44 may be held in place laterally by means of one or more cotter pins 35 or similar restraining devices. A reset arm spring 43 (which is best seen in FIG. 12) is wound around and rotatably disposed about the reset arm pivot rod 44 and provides torque to the rear of the reset arm supports 41 and the attached reset plate 14 sufficient to bias reset arm supports 41 and the attached reset plate 14 forward, in an upright position.

It should be noted, as FIGS. 12 and 13 illustrate, that the reset arm pivot rod 44 has a portion that extends well beyond the side edge of the reset assembly 17, and that an elongated reset assembly pin 46 extends from the side of the reset mount 42. This permits the reset assembly 17 to be attached to one of the side rails 20 of the frame 15, such that the extended portion of the reset arm pivot rod 44 is disposed through a hole in the side rail 20, and through the latch mount 24 nearest to the side rail 20 (e.g., as shown at the top of FIG. 4). The reset assembly pin 46 is appropriately sized and shaped to fit into a hole, groove, or recess in the side rail 20, and the reset assembly pin 46 and reset arm pivot rod 44 attach the reset assembly 17 to the rest of the automatic reset target plate rack assembly 10, e.g., as shown in FIGS. 1 and 2, which illustrate the placement of the reset assembly 17.

Figure 14:
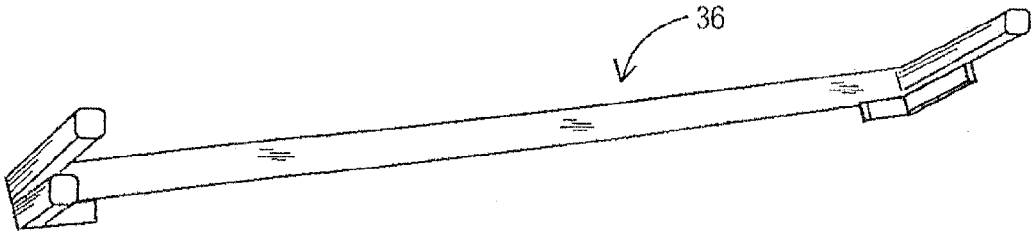
FIG. 14 is a perspective view of an exemplary release arm, in the automatic reset target plate rack assembly of FIG. 1.
Figure 20:
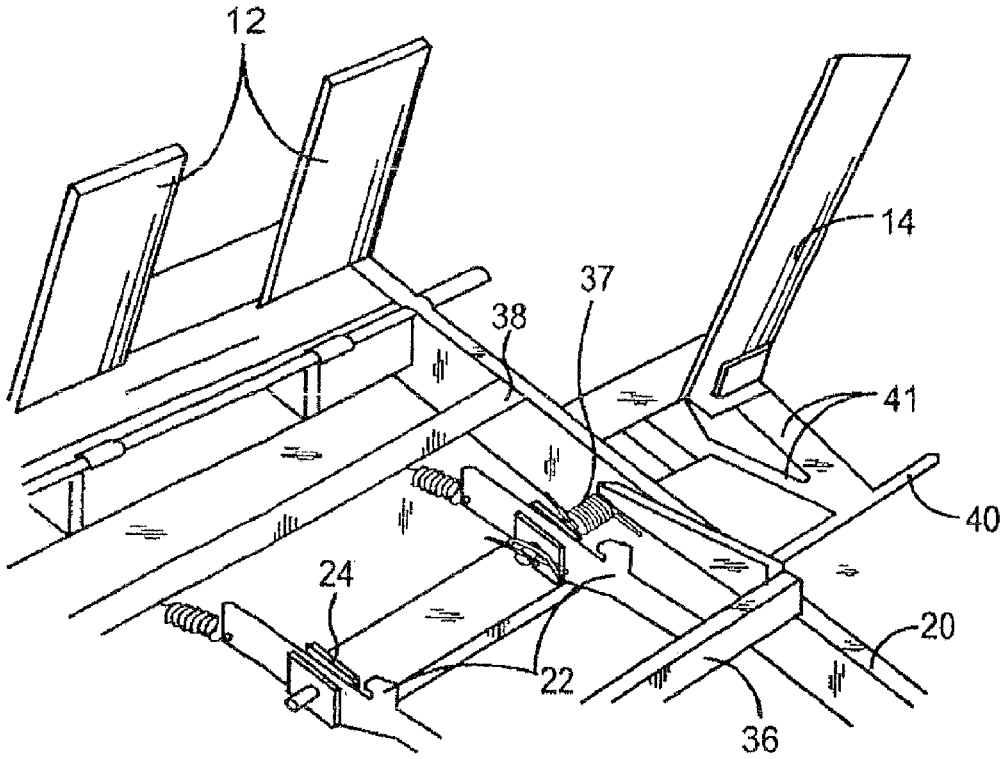
FIG. 20 is a top perspective cutaway view of a portion of the reset assembly, illustrating the location of the release arm spring, in the automatic reset target plate rack assembly of FIG. 1.

With reference still to FIGS. 1 and 2, a U-shaped release arm 36 (which is individually shown in the perspective view of FIG. 14) is rotatably disposed between the side rails 20, fastened to the side rails 20, e.g., by means of release arm pivot rods (not visible in the drawings), and is adapted to rest just above the rear top surfaces of the latches 22. As is best seen in FIG. 20, a release arm spring 37 is disposed between the side rail 20 and the adjacent latch mount 24. The release arm spring 37 is used to correctly balance the release arm 36 by biasing it upward, to prevent the release arm 36 from releasing the latches 22 under its own weight when the release arm 36 is in a resting position. A cotter pin 35 (visible in FIG. 1) secures the release arm pivot rods to the side rails 20.

When the reset plate 14 is in an upright position, the reset arm 40 rests just above the release arm 36. When the reset plate 14 is struck from the front by a projectile, the reset plate 14 travels rearward and downward along with the reset arm 40, which places downward pressure on the release arm 36, causing the release arm 36 to engage the rear surfaces of the latches 22 and place downward pressure thereon, causing each latch 22 that is captivating a target plate 12 to release the captive target plate 12. Thus, after a user has struck one or more target plates 12 with projectiles, causing the target plates 12 to be captivated by the latches 22, the user may simply strike the reset plate 14 with a projectile in order to reset the target plates 12 to their upright positions.

It should be noted that the reset arm 40 extends from the reset arm supports 41 on both sides thereof, and that the positions of the reset mount 42 and reset arm pivot rod 44 may be reversed, such that the reset assembly 17 can be located on either the left or right side of the target plate rack assembly 10. Depending on whether the application is low-caliber or high-caliber, reset plates 14 having varying heights may be used to provide increased leverage and sufficient torque for the reset assembly 17 to overcome the force provided by the latch springs 24, when the reset plate 14 is struck from the front by a projectile. For example, a 20-inch tall plate may be appropriate for use with high-power rounds (e.g., .30-06 or .308) and a 26-inch tall plate may be appropriate for use with lower-power rounds (e.g., .22 or .223).

The release arm 36 may be painted a bright color, e.g., orange, so that when the assembly 10 is set up on a downhill or uphill terrain, should the rear of the assembly 10 be set too high such that the release mechanism is exposed, the user can easily see the release arm 36 and realize that the rear of the assembly 10 needs to be lowered prior to using the assembly 10 to prevent damage to the release arm 36 and other internal components.

Figure 15:
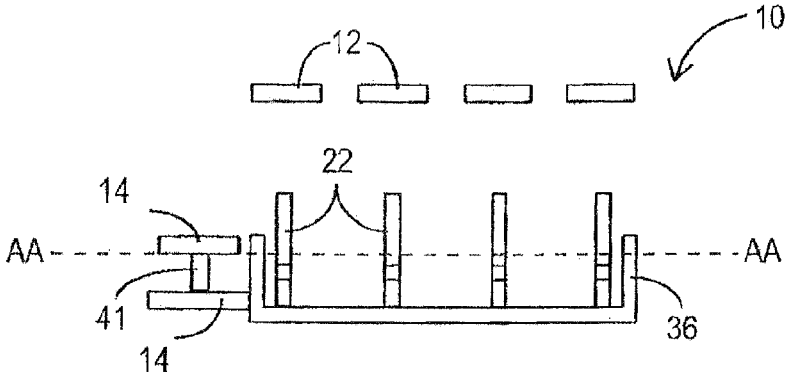
FIG. 15 is a top plan view of the relative placement of the target plates, latches, reset arm, reset arm supports, reset plate, and release arm, in the automatic reset target plate rack assembly of FIG. 1.

With reference now to FIG. 15, a plan view of the relative placement of the target plates 12, latches 22, reset arm 40, reset arm supports 41, reset plate 14, and release arm 36, is provided. It should be noted that the latches 22, the release arm 36, and the reset assembly 17 all pivot along the same axis AA-AA. The latch pivot rods 34, release arm pivot rods, and the reset arm pivot rod 44 may thus be interchangeable when substantially similarly dimensioned, and it is contemplated that the latch 22 closest to the reset assembly 17 shares a pivot rod 34/44 with the reset assembly 17 and one end of the release arm 36 through a hole in the side rail 20, and through the latch mount 24 nearest to the side rail 20 (e.g., as shown at the top of FIG. 4).

Figure 16:
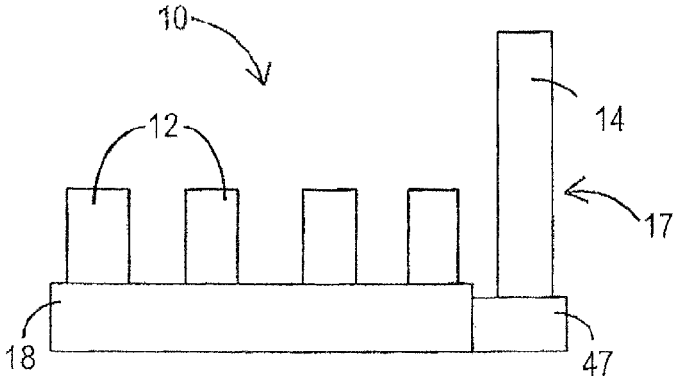
FIG. 16 is a front elevational view of the fully-assembled exemplary automatic reset target plate rack assembly of FIG. 1.

As illustrated in FIG. 16, which is a front elevational view of the fully-assembled exemplary automatic reset target plate rack assembly 10, a reset shield 47 constructed of a hard, dense material, such as AR-500 armor plating, may be disposed (e.g., by welding to the side rail 20) forward of the reset mount 42 (e.g., at reset shield location 25 in FIG. 2) and angled downward in the same manner as the front armor shield 18, such that a projectile striking the reset shield 47 is deflected toward the ground, and the reset shield 47 is disposed so as to protect the components of the reset assembly 17 located behind the reset shield 47 both from direct hits and from the "splatter" of projectile fragments.

With reference still to FIG. 16, when the target plate rack assembly 10 is viewed from the front, all of the visible surfaces, i.e., the target plates 12, front armor shield 18, reset plate 14 and reset shield 47, are desirably formed from hard, dense material, such as AR-500 armor plating, thereby providing protection to all of the internal components behind the armor plating surfaces (many or all of which are desirably constructed from a lighter material, e.g., mild steel).

Figure 17A:
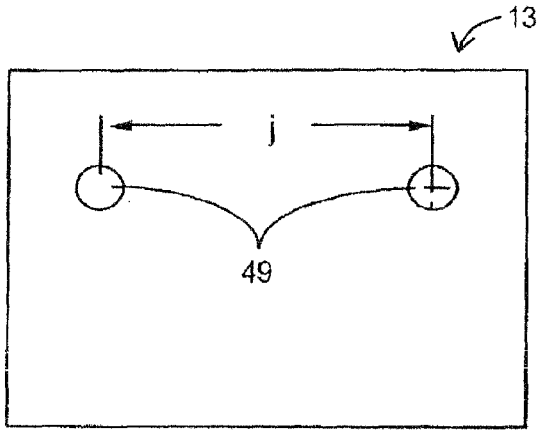
FIG. 17A is a front elevational view of an exemplary target plate mount for use in the automatic reset target plate rack assembly of FIG. 1.
Figure 18:
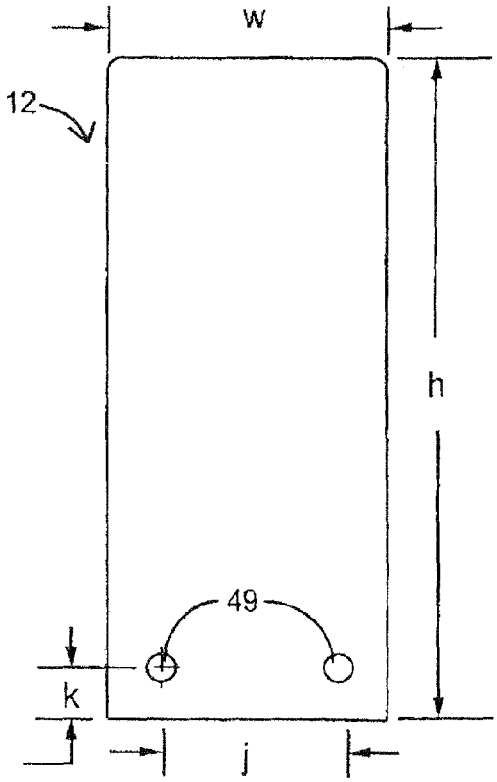
FIG. 18 is a front elevational view of an exemplary rectangular target plate for use in the automatic reset target plate rack assembly of FIG. 1.
Figure 19B:
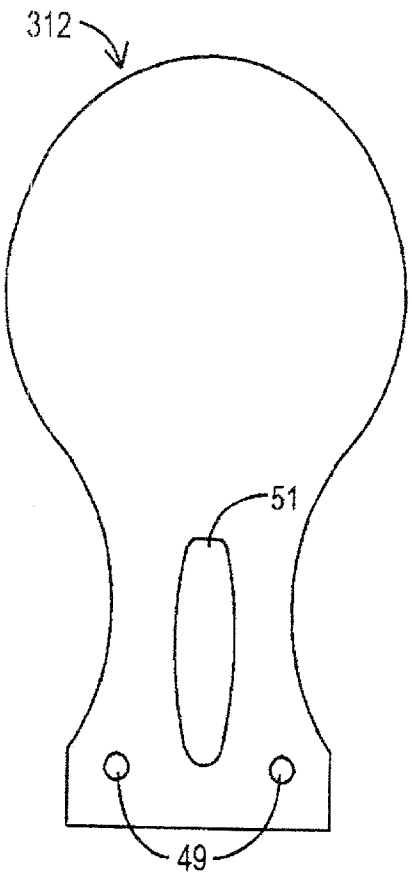
FIG. 19*b* is a front elevational view of an exemplary rounded target plate having a cut-out formed therein, for use in the automatic reset target plate rack assembly of FIG. 1.
Figure 19A:
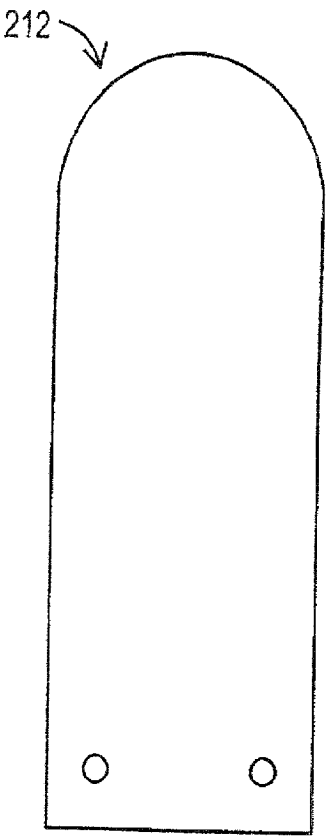
FIG. 19*a* is a front elevational view of an exemplary tombstone-shaped target plate for use in the automatic reset target plate rack assembly of FIG. 1.
Figure 19:
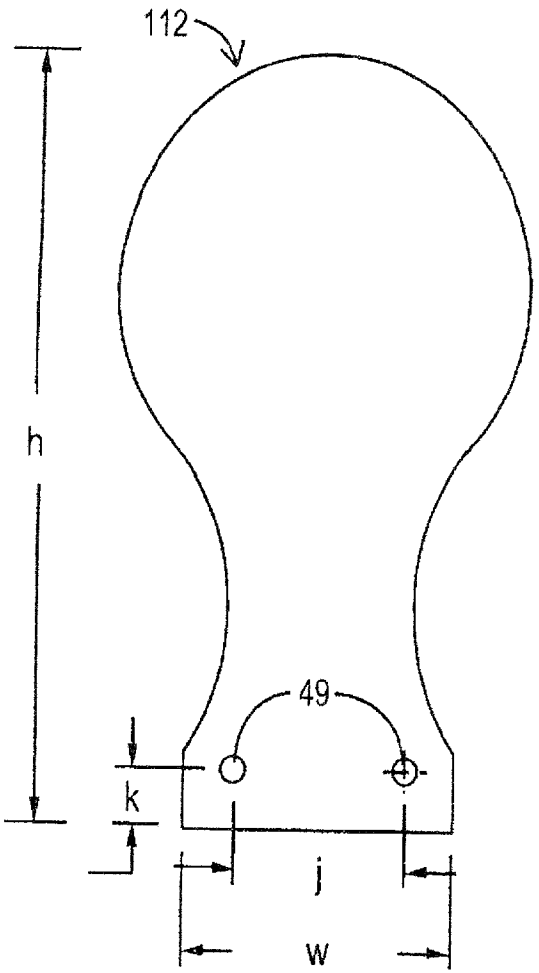
FIG. 19 is a front elevational view of an exemplary rounded target plate for use in the automatic reset target plate rack assembly of FIG. 1.

Several aspects of the present invention may contribute to its modularity, including, as mentioned hereinabove, the modularity and interchangeability of the target plates 12. FIG. 17A is a front elevational view of an exemplary target plate mount 13, wherein the distance between the centers of the through holes 49 is j. As shown in FIGS. 18 and 19, which are front elevational views of an exemplary rectangular target plate 12 and an exemplary rounded target plate 112, respectively, the through holes 49 in each of the target plates 12, 112 have the same distance j between their centers. The target plates 12, 112 also have a distance k (which is important so that the target plates rest on and abut the shelf 21) from the center of the through holes 49 to the bottom of the target plates 12, 112, a height h, and a width w. Another exemplary shape for a target plate 212 might be a tombstone shape, i.e., a rectangular plate rounded at one end, as shown in FIG. 19*a*. Thus, interchangeable target plates may be constructed in countless shapes and sizes, so long as the relative measurements h, w, j, and k remain the same.

Figure 17B:
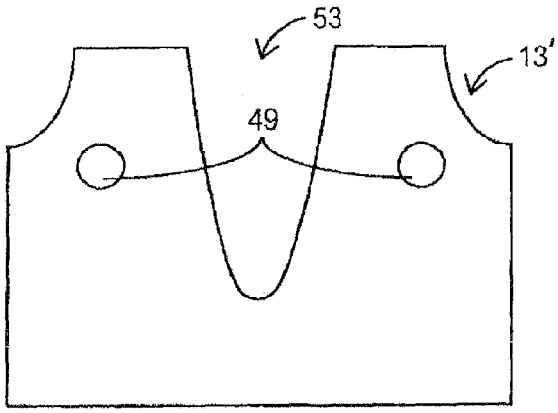
FIG. 17B is a front elevational view of an exemplary target plate mount having a cut-out formed therein, for use in the automatic reset target plate rack assembly of FIG. 1.

In a preferred embodiment, h is 10 inches, w is 4 inches, j is 2.5 inches, and k is 0.75 inches, and while these dimensions are merely exemplary, it is believed that these dimensions are optimal for use in a variety of applications, including long-range or short-range, and high-caliber or low-caliber use. It is further believed that the use of target plates 12 dimensioned so that the ratio of h:w is approximately 1:2.5 (or at least 1:2.5 for taller plates, e.g., reset plates) is desirable to provide long life to the plates 12 and sufficient to accommodate a variety of rounds and applications. The thickness of the target plates 12 may also vary, depending on the distance from the shooter to the target plate and whether light or heavy caliber rounds are being used. For example, while in a preferred embodiment, the thickness of the target plates 12 is desirably 0.375 inches, target plates 12 having a thickness of 0.25 inches may be appropriate for pistol use (whereas 0.25 inches would be too thin for rifle fire, which might bend the plates), and target plates 12 having a thickness of 0.3125 inches may be appropriate for long-range use with .223 caliber rounds. As shown in FIG. 19*b*, it should also be noted that a target plate 312 might alternatively have a cut-out 51 formed in one or more portions thereof (where structural support is not affected), to provide a target plate 312 of reduced weight or mass, which may have particular utility with lighter (e.g., .223 caliber)

rounds. In this scenario, as illustrated in FIG. 17B, the target plate mount 13' may be provided with a similar corresponding cut-out 53 to reduce weight or mass of the target plate mount 13' and thereby permit capture of the target plate 312 with reduced force to accommodate the lighter rounds.

Another aspect of modularity, as mentioned hereinabove, is the interchangeability of the latch pivot rods 34, release arm pivot rods, and the reset arm pivot rod 44. It is further contemplated that two or more target plate rack assemblies 10 may be interconnected or "twinned," with a reset assembly 17 disposed therebetween. In this scenario, the latch 22 in each target plate rack assembly 10 closest to the reset assembly 17 shares an elongated pivot rod 34/44 with the reset assembly 17 and with the inner ends of the respective release arms 36 of the assemblies 10 through holes in the side rails 20, and through the latch mounts 24 nearest to the side rails 20. Thus, a single reset assembly 17 may be used to engage both of the release arms 36 at once, thereby permitting all of the target plates 12 of both assemblies 10 (i.e., all eight plates, if each assembly has four plates) to be reset with a single striking of the reset plate 14.

Figure 21:
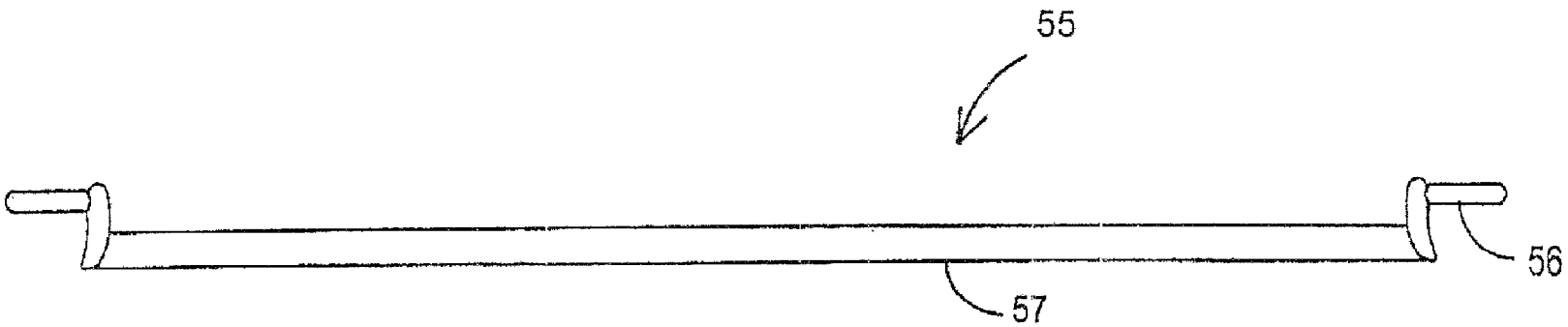
FIG. 21 is a perspective view of an exemplary plate spring tension adjustment crank, in an automatic reset target plate rack assembly consistent with the present invention.
Figure 22:
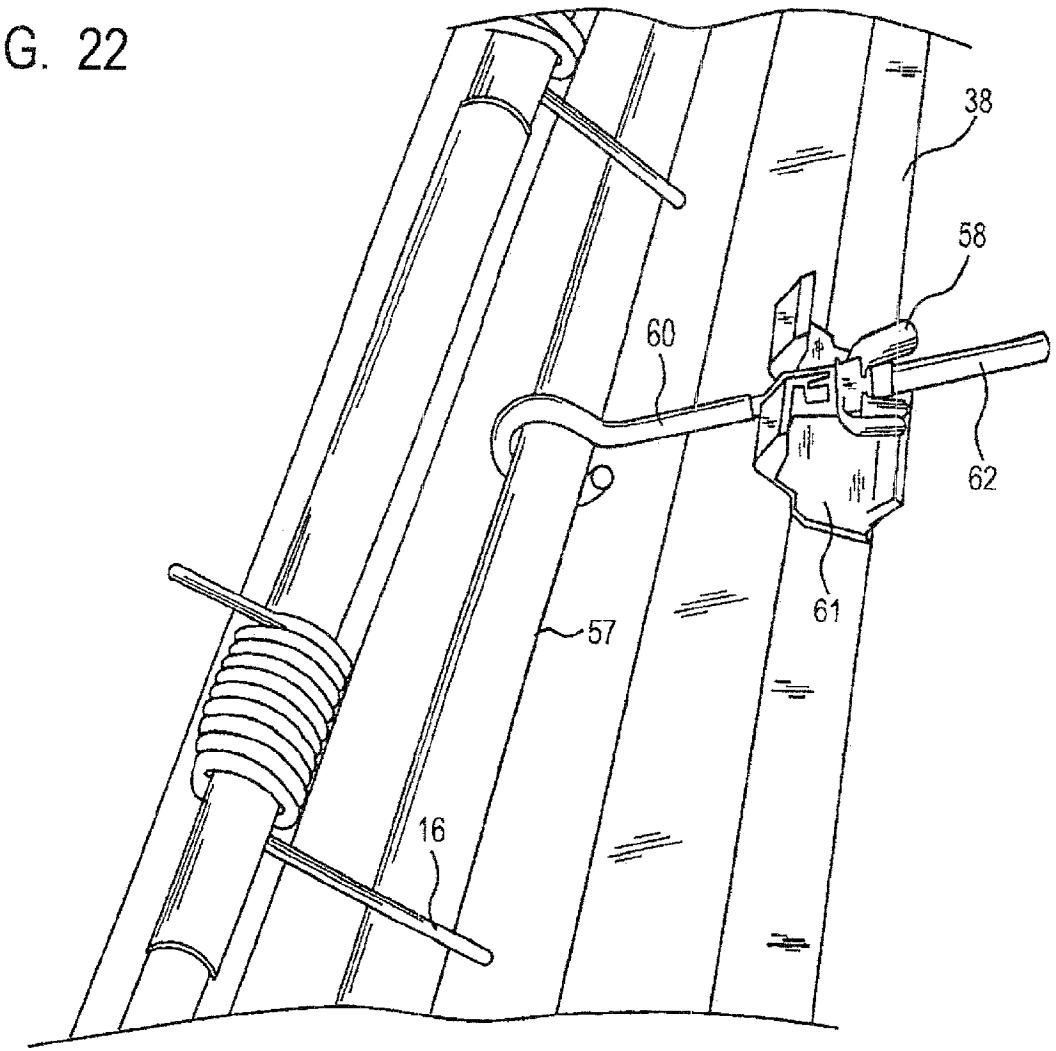
FIG. 22 is a side perspective view of the exemplary spring tension adjustment crank of FIG. 21, in its installed position in the target plate rack.

It should also be recognized that target plates intended to be interchangeable should desirably have substantially the same mass, as well, to eliminate the necessity for substantial adjustment of other components to which the plates are interconnected. Notwithstanding, if such adjustment is desirable, a plate spring tension adjustment crank 55 may be used. With reference to FIGS. 21 and 22, the plate spring tension adjustment crank 55 is disposed between the side rails 20 and secured by appropriately-sized openings in the side rails 20 (not shown in the drawings), such that the central portion 57 of the crank 55 rests beneath the plate springs 16. The crank 55 has handles 56 that project from the outer edges of the side rails 20, and its position is secured by a hook 60. The hook 60 has threads 62 at one end and a wing nut 58 (e.g., nylock) threadably disposed on the threads 62 of the hook 60 against a stop bracket 61 mounted on the latch spring attachment shield 38, such that the wing nut 58 that may be tightened to prevent rotation of the crank 55. When the wing nut 58 is loosened, turning the handle 56 of the crank 55 permits a user to raise or lower the central portion 57 of the crank 55, thereby increasing or decreasing the spring tension of the plate springs 16. The spring tension should adjusted so as to provide sufficient torque to the target plates 12 to reliably maintain the target plates 12 in an upright position, while still permitting the target plates 12 to be captured by the latches 22 when struck from the front by a projectile.

Additionally, the target plate rack assembly 10 is desirably constructed such that the pivots, target plates, and reset plate all use the same mounts, which permits the variously sized and shaped target plates and the reset plate all to be interchangeable.

All of the components of the target plate rack assembly 10 described as being desirably constructed from a hard, dense material such as armor plating are desirably 0.375 inches in thickness. The components of the assembly 10, including holes and facets formed therein, are preferably formed precisely by means of, e.g., laser-cutting. It should further be appreciated that additional sections of armor plating or other hard, dense material not specifically described herein may be disposed in various places to protect internal components of the assembly 10.

Figure 23:
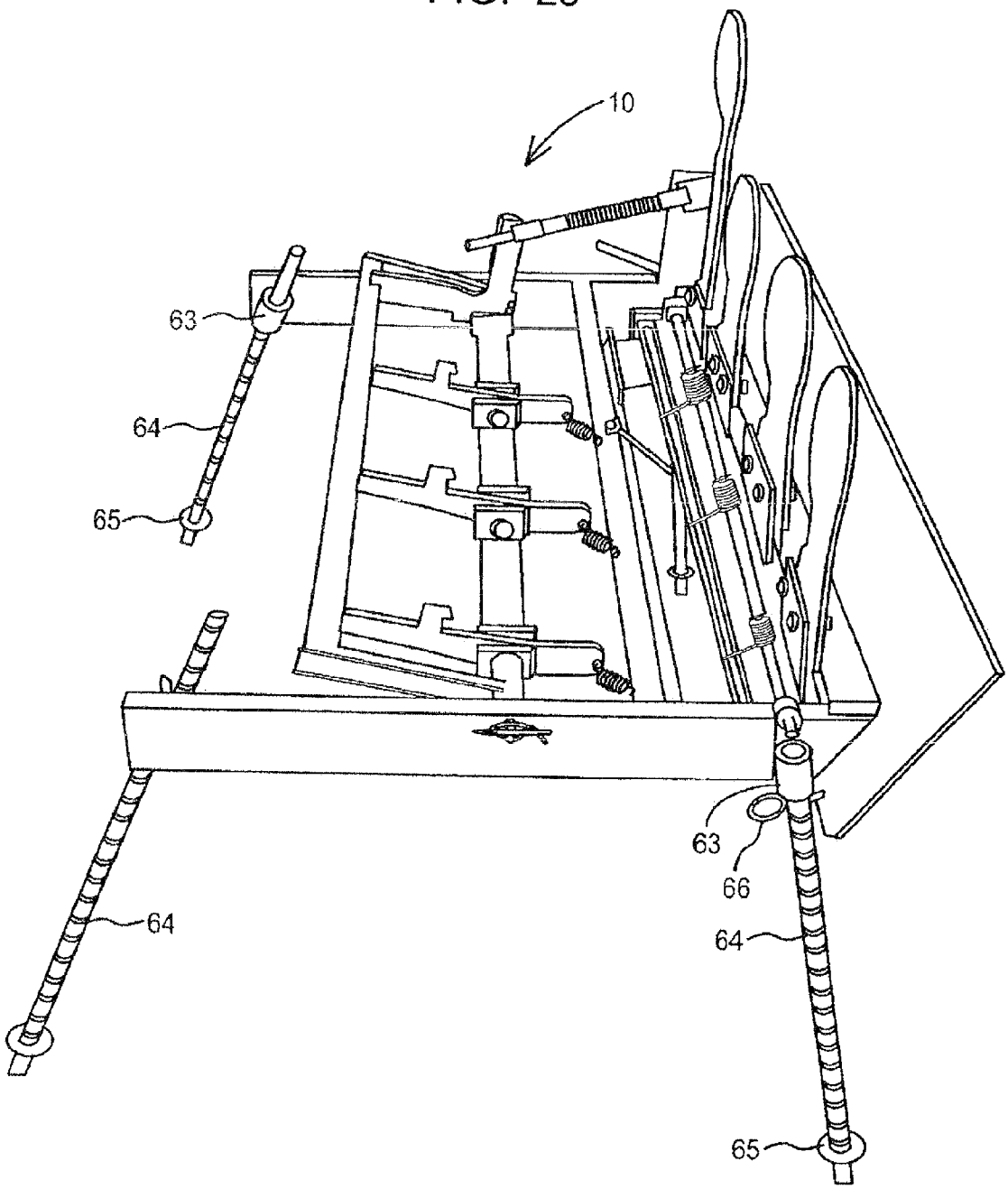
FIG. 23 is a side perspective view of an exemplary target plate rack, consistent with the present invention, with legs installed.

Further modifications are possible. For example, as illustrated in FIG. 23, a plurality of leg mounts 63 (which could be recesses or other mating features) may be provided on the frame 15 to permit the installation of legs 64 (or other support members), so that the target plate rack assembly 10 can be used at a higher level than ground level. The legs 64 may be constructed from a variety of materials, e.g., 0.75 inch rebar. Short legs may be desirable when the assembly 10 is used near the ground in a grassy area. The legs 64 may have feet disposed thereon, e.g., round metal disks 65, for when the assembly 10 is used on soft soil or other soft surfaces. Eye bolts 66 or other fastening mechanisms may be provided to hold the legs 64 securely in the leg mounts 63, and corresponding holes (not shown) may be formed in the legs 64 to receive the bolts 66 and thereby secure the legs 64. Copper sleeves (not shown) or other materials may be applied to the outside surfaces of the legs 64 and/or leg mounts 63 to protect against corrosion, particularly in long-term installations.

Figure 24:
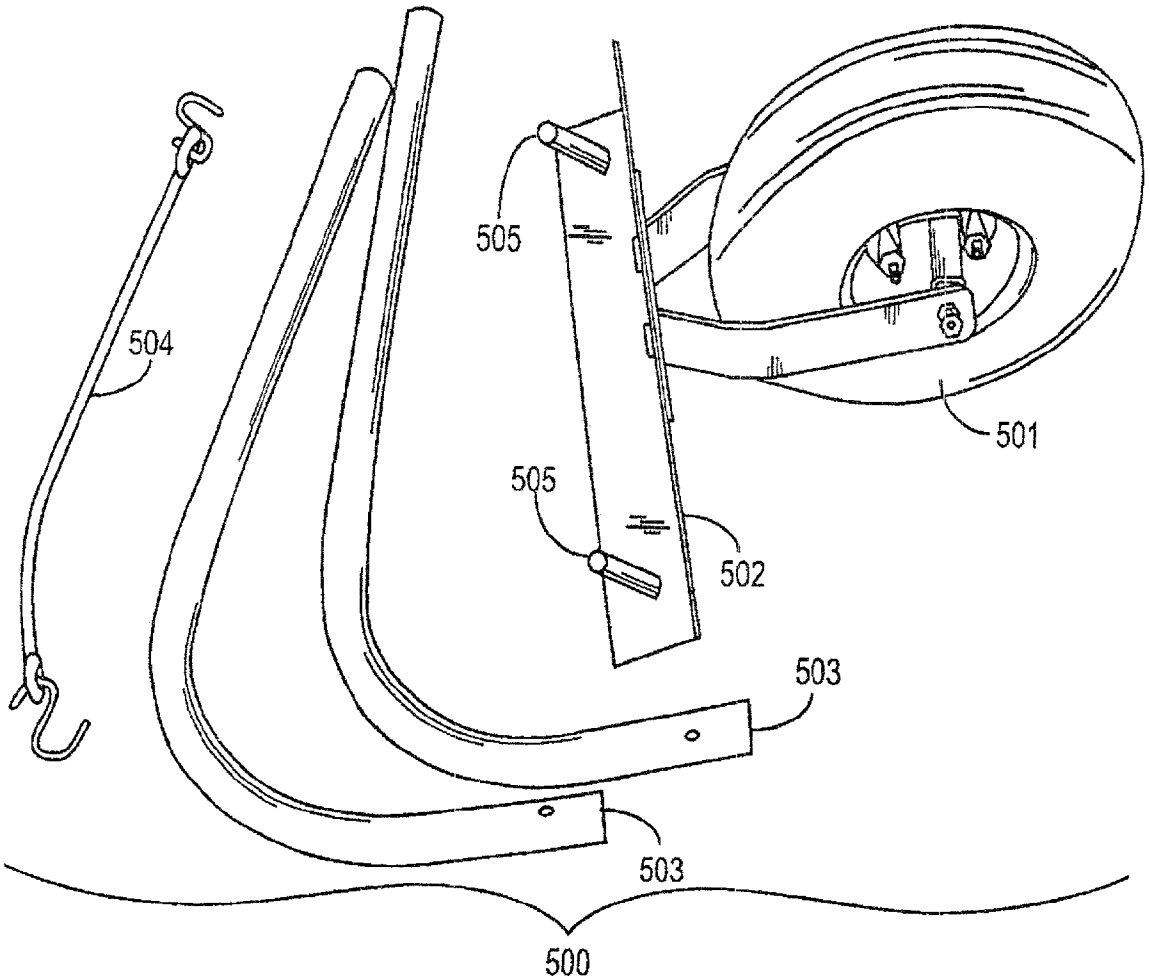
FIG. 24 is a perspective view of the individual components of an exemplary mobility kit in one embodiment of the invention.
Figure 25:
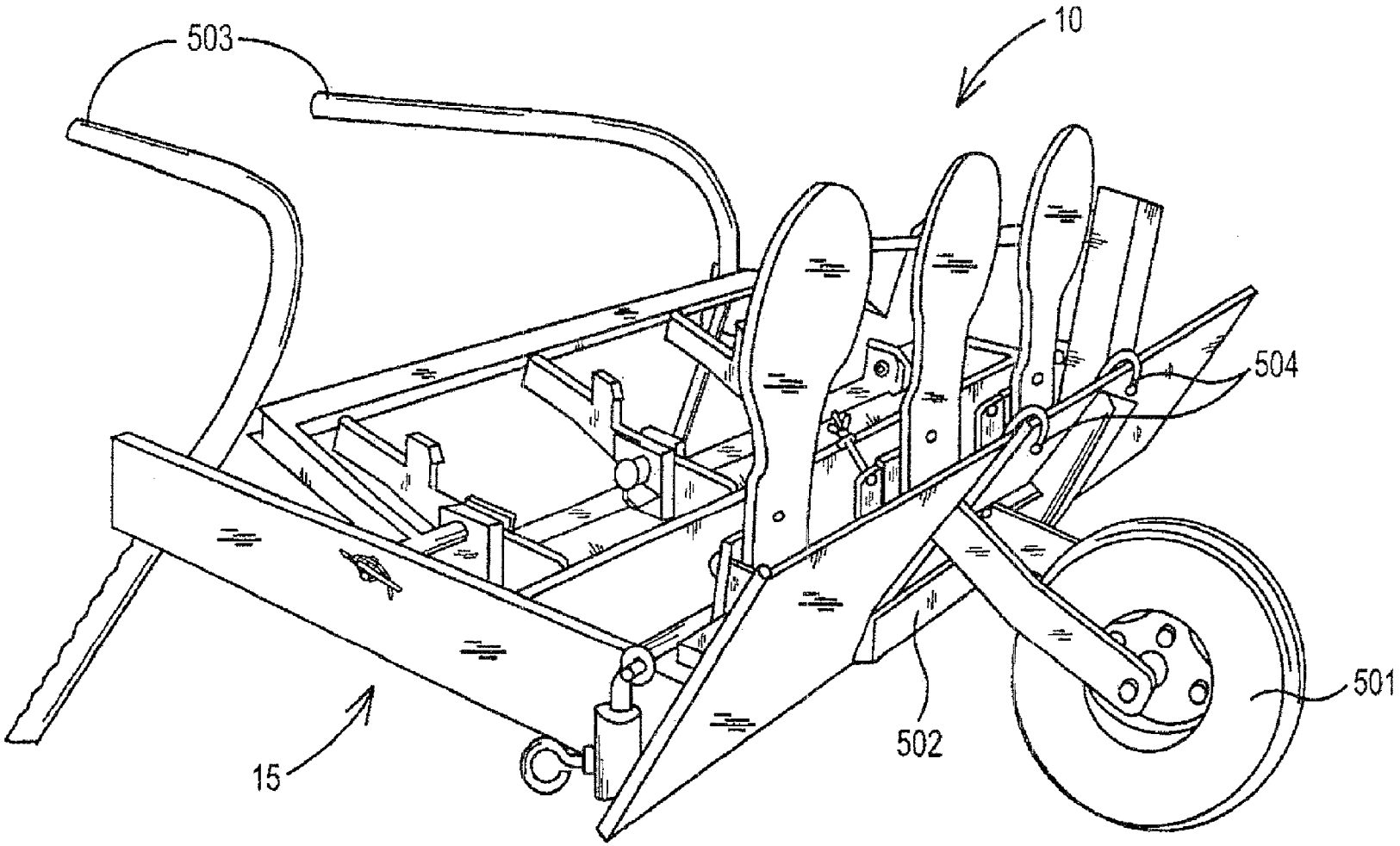
FIG. 25 is a side elevational view of the exemplary mobility kit of FIG. 24 installed in an exemplary target plate rack.

Since the target plate rack assembly 10 may be large and heavy, a detachable mobility kit may be used to aid in relocating the assembly 10. FIGS. 24 and 25 illustrate respectively the individual components of an exemplary mobility kit 500, and the mobility kit 500 attached to a target plate rack assembly 10 in one embodiment of the invention. As shown, the mobility kit 500 includes a wheel 501, e.g., a pneumatic wheelbarrow tire, disposed on a bracket 502 that couples the wheel 501 to the bottom edge of the front of the frame 15 by means of a pair of holes (not visible in FIGS. 24 and 25) formed in the frame 15 for receiving a pair of corresponding protrusions 505 on the bracket 502. The kit 500 also includes a pair of elongated handles 503 adapted to slide through and be secured into the rear leg mounts 63 on the assembly 10. A bungee cord 504 is provided for securing the wheel bracket 502 and wheel 501 onto the frame 15. In this wheelbarrow-like configuration, a user can lift the lighter, rear portion of the assembly 10 using the handles 503, while permitting the weight of the heavier front end to be supported by the wheel 501 during travel.

Figure 26:
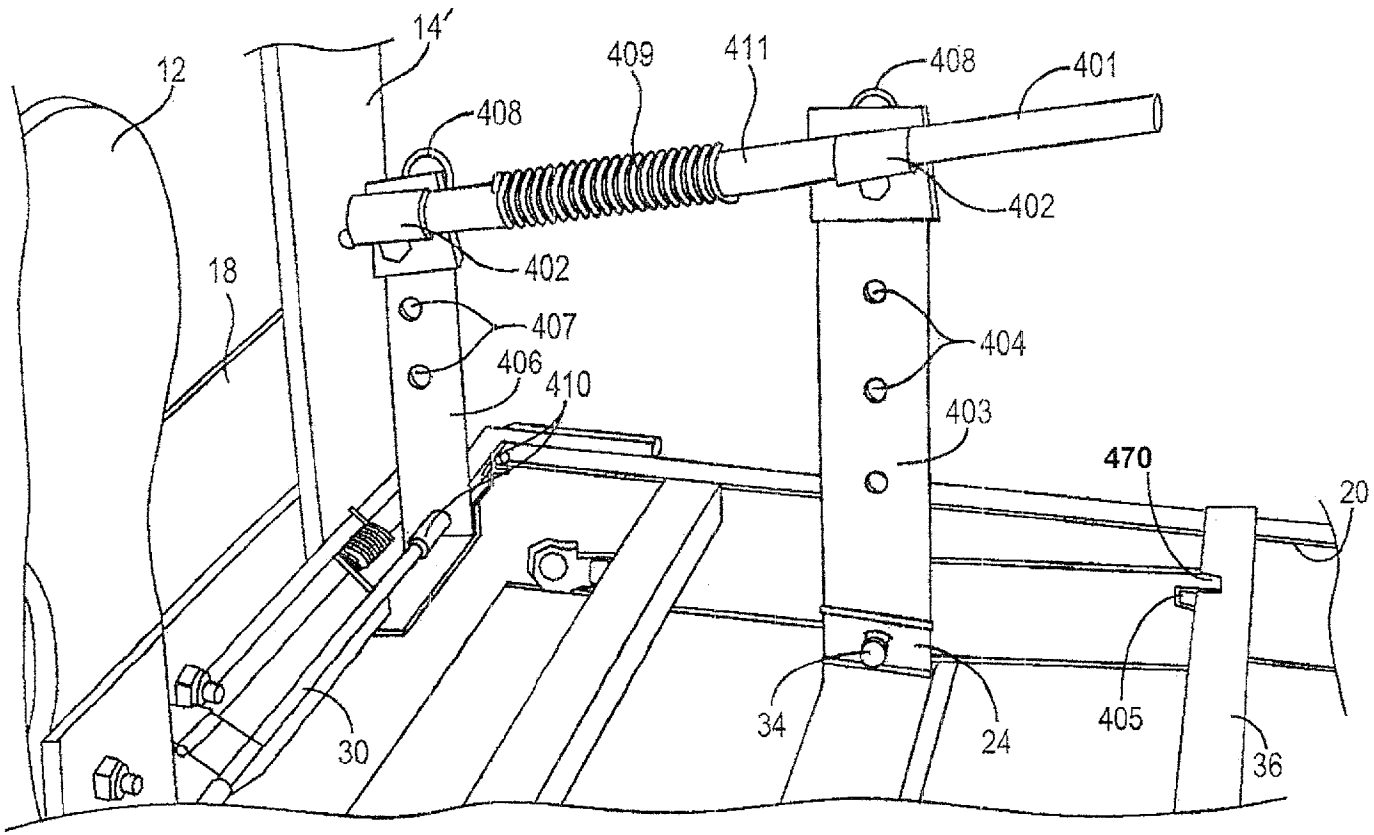
FIG. 26 is a side elevational view of an alternative reset assembly consistent with the present invention.

FIG. 26 illustrates an alternative reset assembly 17' that can be installed in place of one of the target plates 12, instead of being disposed beyond the frame 15 of the target plate rack assembly 10, as is the case with the reset assembly 17 described above. Therefore, the alternative reset assembly 17', which can be used with slightly modified short or tall reset plates 14' (depending on the leverage needed for the rounds being used), may not require any mounting holes to be formed in the frame 15. The alternative reset assembly 17' includes a reset rod 401 supported by two reset rod support brackets 402, with a reset rod spring 409 and a collar 411 disposed around the reset rod 401 and held between the support brackets 402. At the rear end of the assembly 17', one support bracket 402 is coupled to one of a plurality of height adjustment holes 404 formed in an L-bracket 403, e.g., by means of a cotter pin 408, such that the support 402 and reset rod 401 can pivot around the cotter pin 408. The L-bracket 403 has a hole (not visible in FIG. 22) formed therein to receive a latch pivot rod 34, on which the L-bracket 403 is pivotally disposed, and the L-bracket 403 is held in place vertically by one of the latch mounts 24. The rear face of the L-bracket 403 has a notch 405 formed therein to clear the release arm 36 and an extension portion 470 that rests on the release arm 36. At the front end of the assembly 17', the other support bracket 402 is coupled to one of a plurality of height adjustment holes 407 in a front reset support bracket 406, e.g., by means of a cotter pin 408, such that the support 402 and reset rod 401 can pivot around the cotter pin 408. The height adjustment holes 404, 407 are selected based, e.g., the caliber of rounds being used, and the proper location of the notch 405 in the L-bracket 403 in relation to the release arm 36. The front reset support bracket 406 is disposed directly behind and coupled (e.g., by welding) to the modified reset plate 14', and both are pivotally disposed on the target plate pivot rod 30 by means of a pair of pivot sleeves 410. When the modified reset plate 14' is in an upright position and the height of the reset rod 401 is correctly adjusted via height adjustment holes 404 and 407, the notch 405 in the L-bracket 403 rests just above the release arm 36. It should be recognized that the brackets 403, 406, and reset rod 401 may be of shapes other than those described above, e.g., the reset rod 401 may have a cross-section other than circular, may not necessarily be cylindrical, may be bent or angled in shape, or may be embodied as a linking element having nearly any shape.

When the modified reset plate 14' of the alternative reset assembly 17' is struck from the front by a projectile, the modified reset plate 14' rotates rearward and downward along with the front reset support bracket 406, the reset rod 401, and the L-bracket 403, which places downward pressure on the release arm 36, causing the release arm 36 to engage the rear surfaces of the latches 22 (not visible in FIG. 22) and place downward pressure thereon, causing each latch 22 that is captivating a target plate 12 to release the captive target plate 12. Thus, after a user has struck one or more target plates 12 with projectiles, causing the target plates 12 to be captivated by the latches 22, the user may simply strike the modified reset plate 14' with a projectile in order to reset the target plates 12 to their upright positions. When the modified reset plate 14' has completed its rearward travel, the reset rod spring 409, which has stored energy from the projectile striking the modified reset plate 14', releases the energy in a forward direction, biasing the modified reset plate 14' to pivot back into its upright position.

Figure 27:
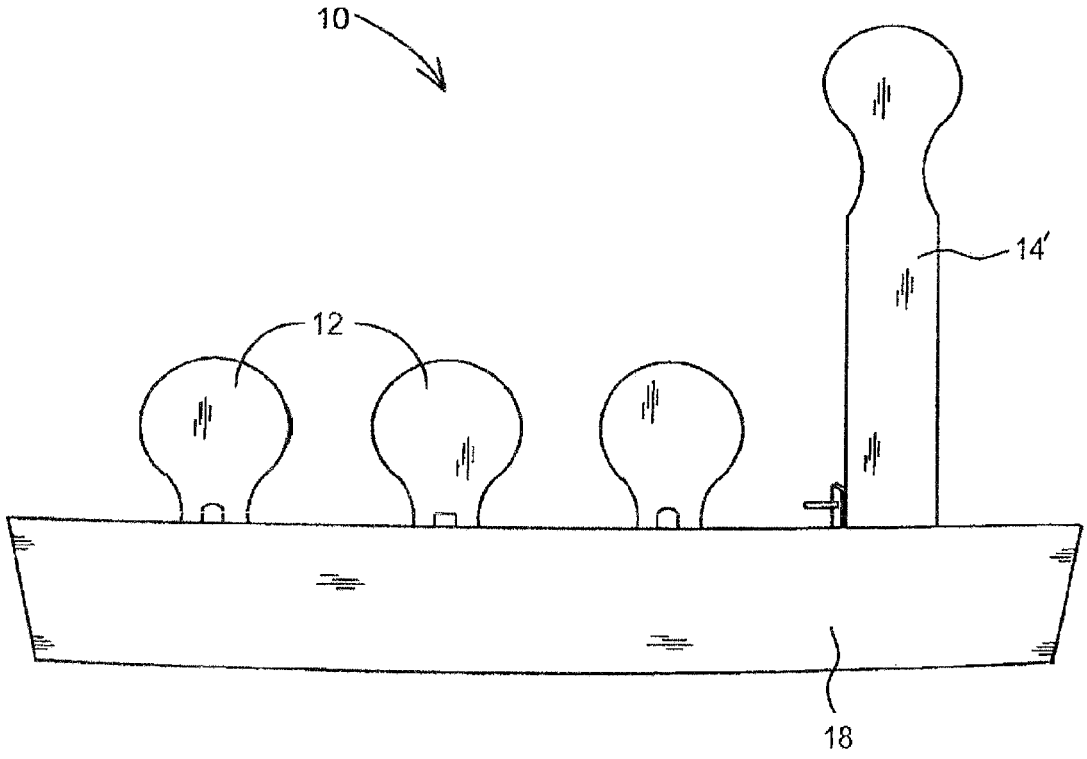
FIG. 27 is a front elevational view of an exemplary target plate rack including the reset assembly of FIG. 26.

As illustrated in FIG. 27, in a target plate rack 10 employing the above-described alternative reset assembly 17', when the target plate rack assembly 10 is viewed from the front, only surfaces made from hard, dense material, e.g., AR-500 armor plating, are visible and strikeable by a projectile, i.e., the target plates 12, front armor shield 18, and modified reset plate 14', thereby providing protection to all of the internal components behind the armor plating surfaces during shooting.

Figure 28:
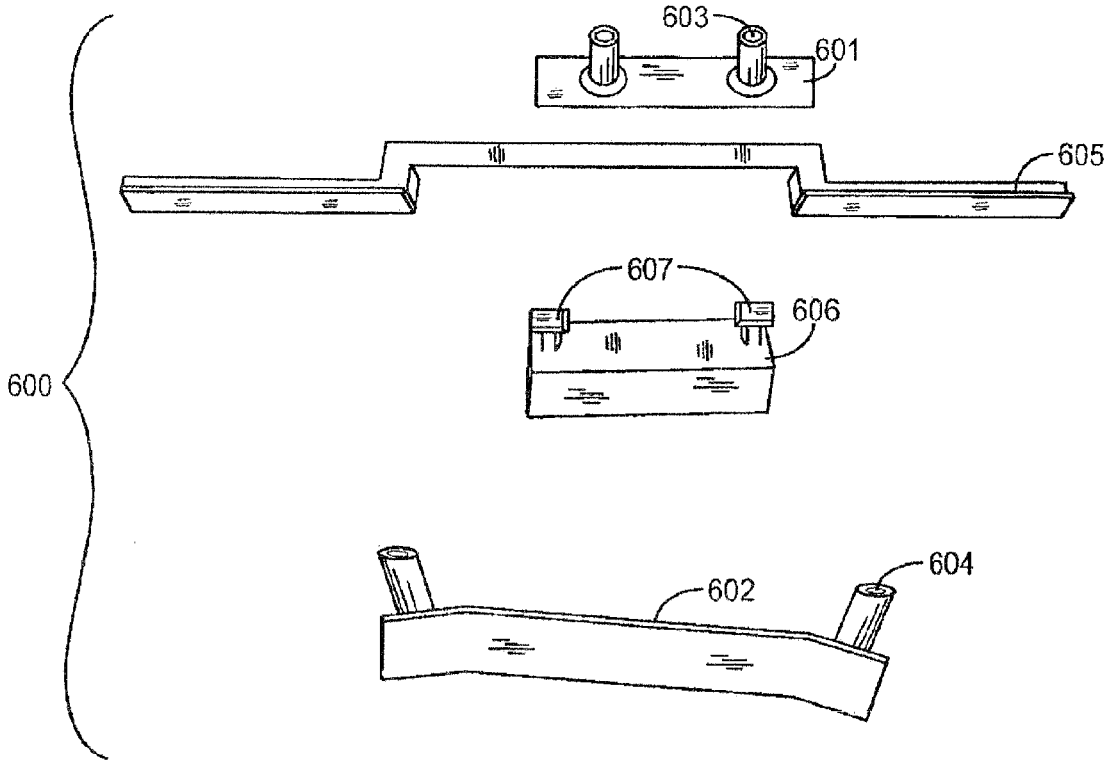
FIG. 28 is a perspective view of the individual components of a "twinning" kit in one embodiment of the invention.

As mentioned hereinabove with respect to reset assembly 17, it is further contemplated that two (or more) target plate rack assemblies 10 may be interconnected or "twinned," such that they share a single alternative reset assembly 17', which may either be mounted in the place of any of the target plates 12 of either of the twinned assemblies 10, or between the assemblies 10. The components of an exemplary twinning kit 600 for use with the alternative reset assembly 17' are illustrated in FIG. 28, which includes a front bridge 601 with projections 603 that fit in the respective adjacent front leg mounts 63 of the frames 15, a rear bridge 604 with projections 604 that fit in the respective adjacent rear leg mounts 63 of the frames 15, a release arm bridge 605 for coupling the release arms of the respective target plate rack assemblies 10 to one another, so that they operate in tandem, and an optional reset arm mount 606. The reset arm mount 606 attaches between the frames 15 of adjacent assemblies 10, has a pair of sleeves 607 formed therein, is dimensioned to hold a latch pivot rod 34 therein, and permits the alternative reset assembly 17' to be mounted between adjacent twinned assemblies 10, rather than in place of one of the target plates 12. In this configuration, the alternative reset assembly 17' may be mounted upright or may hang downward, depending on whether the reset arm mount 606 is installed upright or upside-down. It should be recognized that the bridge components 601, 603, 605 may employ mating features other than projections and apertures to couple the assemblies 10 to one another.

Figure 29:
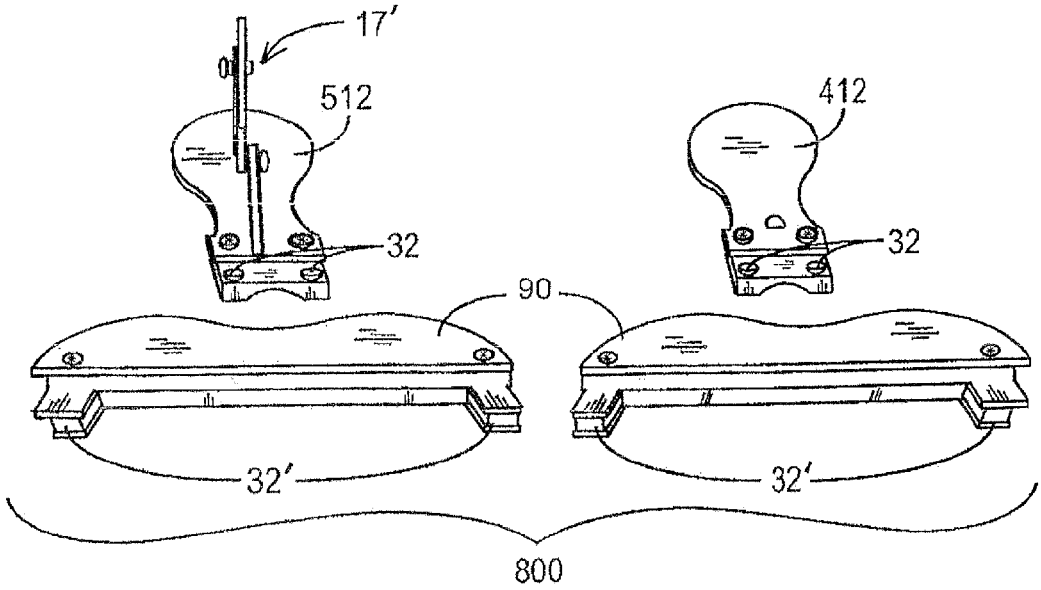
FIG. 29 is a rear perspective view of a disassembled exemplary pair of shields having human-like forms, in an automatic reset target plate rack assembly consistent with the present invention.
Figure 30:
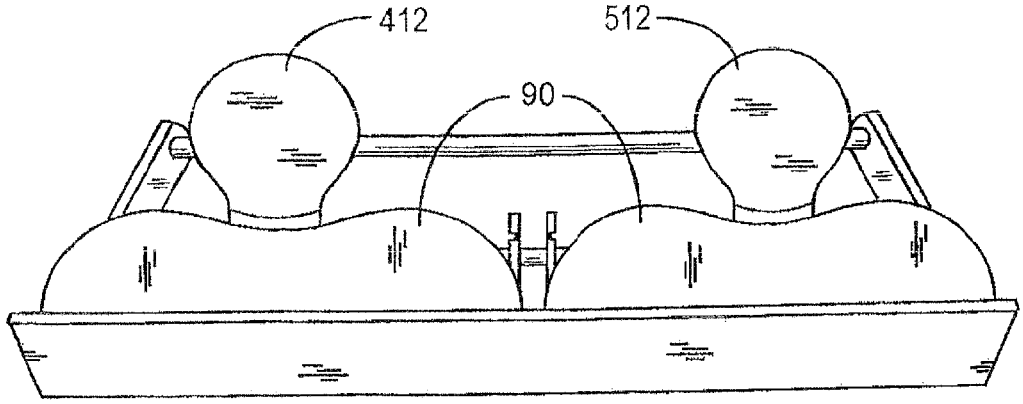
FIG. 30 is a front elevational view of the assembled exemplary pair of shields of FIG. 29.

As illustrated in the disassembled rear elevational view of FIG. 29 and the assembled front elevational view of FIG. 30, another modification which may be appropriate for military or police training or long-range competitions is a "sniper-countersniper" configuration employing two human-like forms, e.g., for use with high-powered rounds, in simulating shooting from a prone position. In this configuration, three adjacent ordinary target plates (not shown) are removed from the assembly 10, and are replaced by a pair of modified elongated rounded "head-shaped" target plate assemblies 412, 512 and a pair of "shoulder-shaped" shields 90. The plate assemblies 412, 512 and shields 90 all are disposed on the pivot rod 30 via respective integral sleeves 32, 32'. Each exemplary target plate assembly 412, 512 includes a gasket (not shown) glued between a target plate 12 and a target plate mount 13, which are bolted together by a pair of bolts 11. One target plate assembly 412 has an ordinary rounded target plate with a slightly longer "neck" portion, and the other target plate assembly 512, which serves as a reset plate, is a rounded target plate also having a slightly elongated "neck" portion, and further includes an alternative reset mechanism 17', as described above. In operation, the user can shoot indefinitely by simply alternately striking the plates 412, 512. If the user misses a plate 412, 512 and instead hits the shields 90, the shields 90 spring back up, and the respective plate 412 does not latch, or plate 512 does not reset.

Figure 31A:
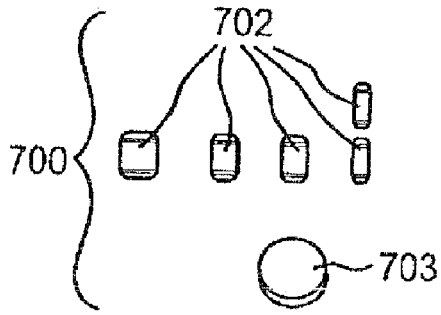
FIG. 31A is a side perspective view of an individual shim kit in one embodiment of the invention.
Figure 31B:
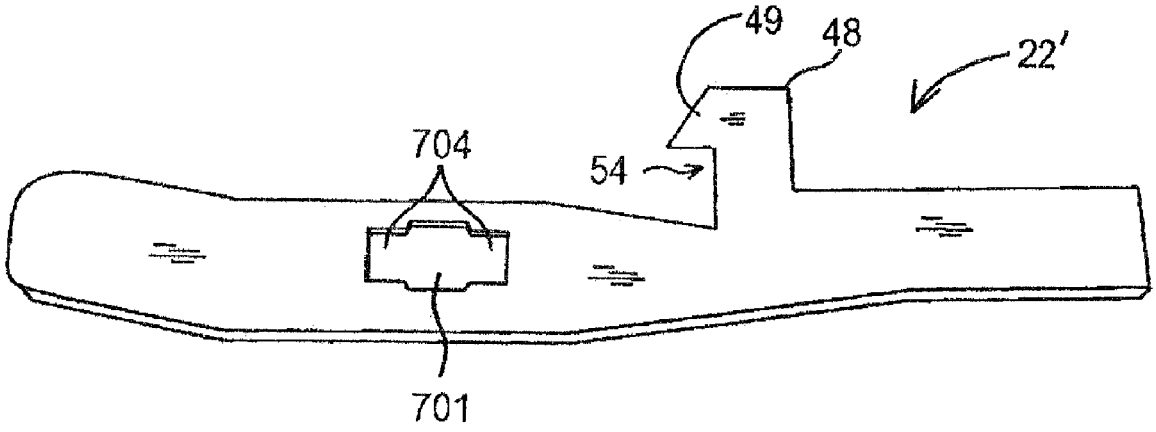
FIG. 31B is a side perspective view of an alternative latch in one embodiment of the invention.
Figure 32:
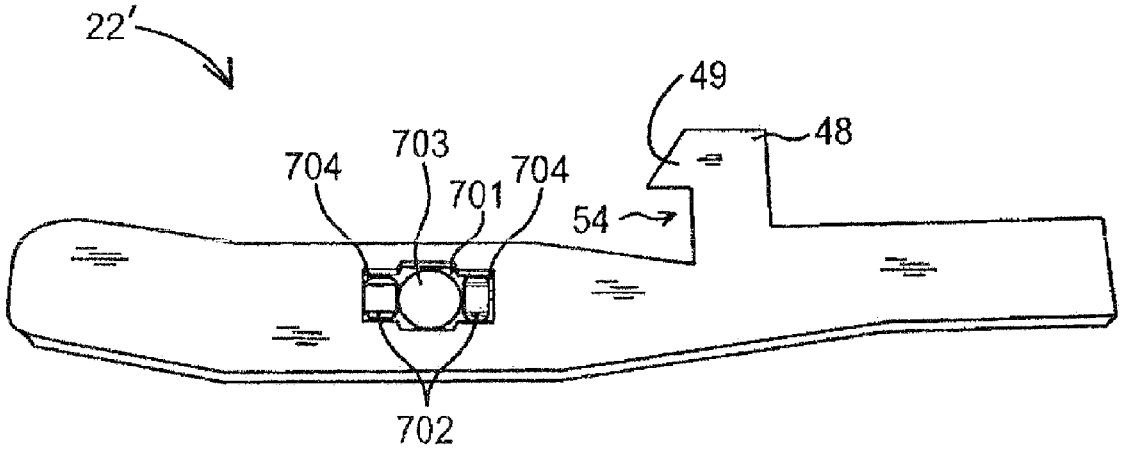
FIG. 32 is a side perspective view of the alternative latch of FIG. 31B with shims installed.

As illustrated in FIGS. 31A-32, another modification is the use of an alternative latch 22' having an adjustable design. As shown, the alternative latch 22' has a cross-shaped, generally rectangular hole 701 formed therein (although holes of other sizes and shapes may alternatively be used), with the center portion of the hole 701 sized to accommodate a latch pivot rod 34 therethrough, and side portions 704 that are sized to accommodate therein shims 702 from a shim kit 700. The shim kit 700 contains a dummy disk 703 and a set of cylindrical (or other shaped) shims 702 of varying diameters and of a length corresponding to the height of the side portions 704 of the hole 701 in the latch 22'. In an exemplary embodiment, the shims provided are 0.1875 inches, 0.25 inches, 0.3125 inches and 0.375 inches. By installing shims 702 of different diameters into the side portions 704 of the hole 701 in the latch 22', the user can adjust the latch 22' forward and rearward, as necessary to align the latch 22' so that it properly captures and releases its respective plate 12 in operation. The alternative latch 22' also includes a generally L-shaped hook portion 48 having a beveled surface 49 and a recess 54 formed therein.

As shown in FIG. 32, the shims 702 are installed with the aid of a dummy disk 703, by placing the latch 22' on a flat surface and dropping the shims 702 into place into the side portions 704 of the hole. The latch 22' is then turned upright and installed into a latch mount 24. Next, a latch pivot rod 34 is pushed into the through hole in the latch mount 24 at one end thereof, thereby pushing the dummy disk 703 through, and ejecting the dummy disk 703 from the opposite end of the latch mount 24, after which the latch pivot rod 34 is secured with a cotter pin 35 (or other device).

The hinges, joints, and other moving parts of the target plate rack 10 are desirably lubricated, e.g., using a molybdenum disulfide-based formulation dry film lubricant in a fast-drying, residue free isopropyl alcohol carrier, such as Smooth Kote™ manufactured by Sentry Solutions Ltd. of Manchester, N.H. In this scenario, the alcohol provides some cleaning action, and when it evaporates, the molybdenum lubricants bond to the pores of the clean metal surfaces.

In certain embodiments, mechanical or electrical indicators may be included in a target plate rack assembly 10 consistent with the present invention, to permit signaling a winner when more than one target plate rack assembly 10 is used simultaneously during competition. For example, a lamp or LED may be provided for each competitor shooting at a given target plate rack assembly 10 with switches or other detection mechanisms for detecting when each of the target plates and the reset plate have been knocked down or have traveled to predetermined positions, indicating successful hits. Thus, the lamp or LED corresponding to the winner is illuminated when the winner is the first to strike all of the target plates and then the reset plate. In this scenario, a lockout relay, silicon-controlled rectifier, or other switching mechanism may be used to prevent illumination of the lamp or LED corresponding to the non-winner(s), such that the winner is easily identified. In one possible variation, when two target plate rack assemblies 10 are positioned together, their respective reset plates may be tied together or otherwise linked, so that when the winner finishes striking all of the target plate and then strikes the reset plate, all of the target plates of both the winner and non-winner are reset, thereby preventing the non-winner from continuing to shoot. A control circuit may be provided to receive signals from the switches of a plurality of target plate rack assemblies 10 during a competition, so as to indicate at a central location the winner, i.e., the first to strike all of the target plates and then the reset plate of their assigned target plate rack assembly 10. Indicators such as those described herein may be implemented using mechanical elements, or electrical circuitry, or a combination of mechanical and electrical components. A wired or wireless network may be used to route the signals from a plurality of target plate rack assemblies 10 during a competition, and indicators may be provided on the assemblies or remote therefrom to indicate a winner. It should be recognized that, although the indicators are described above as being LEDs or lamps, an indicator could alternatively or additionally comprise a buzzer or other sound, such as a synthesized human voice, and the indicators may be provided to appropriate software, e.g., in a microcomputer or other device containing a microprocessor and/or communications devices for interfacing with one or more target plate rack assemblies 10 consistent with the present invention.

Although the present invention has been set forth in terms of the embodiments described herein, it is to be understood that such disclosure is purely illustrative and is not to be interpreted as limiting. Consequently, without departing from the spirit and scope of the invention, various alterations, modifications, and/or alternative applications of the invention will, no doubt, be suggested to those skilled in the art after having read the preceding disclosure. Accordingly, it is intended that the present invention be interpreted as encompassing all alterations, modifications, or alternative applications as fall within the true spirit and scope of the invention.

REFERENCE NUMERAL LIST

10 automatic reset target plate rack assembly
11 bolt
12 target plate
13 target plate mount
13' target plate mount with cut-out
14 reset plate
14' alternative reset plate
15 frame
16 plate spring
17 reset assembly
17' alternative reset assembly
18 front armor shield
19 front rail
20 side rail
21 shelf
22 latch
22' alternative latch
24 latch mount
25 location of reset shield
26 latch mount crossbar
28 latch spring
30 target plate pivot rod
32 target plate pivot sleeve
34 latch pivot rod
35 cotter pin
36 release arm
37 release arm spring
38 latch spring attachment shield
40 reset arm
41 reset arm support
42 reset mount
43 reset arm spring
44 reset arm pivot rod
45 reset arm pivot sleeve
46 reset assembly pin
47 reset shield
48 hook portion of latch
49 beveled surface of latch
50 latch over-travel contact area
51 cut-out in rounded target plate
52 latch mount over-travel stop area
53 cut-out in target plate mount
54 latch recess
55 plate spring tension adjustment crank
56 handle
57 central portion
58 wing nut
59 target plate through hole
60 hook
61 stop bracket
62 threads
63 leg mount
64 leg
65 metal disk
90 "shoulder-shaped" shield
112 rounded target plate
212 tombstone-shaped target plate
312 rounded target plate with cut-out
401 reset rod
402 reset rod support bracket
403 L-bracket
404 height adjustment holes in L-bracket
405 notch in L-bracket
406 front reset support bracket
407 height adjustment holes in front reset support bracket
408 cotter pin
409 reset rod spring
410 front reset support bracket pivot sleeve
411 collar
412 elongated rounded "head-shaped" target plate assembly
470 extension portion of L-bracket
500 mobility kit
501 wheel
502 bracket
503 handle
504 bungee cord
505 protrusions in bracket
512 elongated rounded "head-shaped" reset plate assembly
600 twinning kit
601 front bridge

602 rear bridge
603 projections on front bridge
604 projections on rear bridge
605 release arm bridge
606 reset arm mount
607 reset arm mount sleeve
700 shim kit
701 rectangular hole
702 shim
703 dummy disk
704 side portion of hole

What is claimed is:

1. A target plate rack comprising:

a target plate pivoting on a first axis;

a latch pivoting on a second axis, said latch positioned to contact said target plate and capture said target plate when said target plate is pivoted to a first predetermined rotational position;

a release arm pivoting separately from said latch and movable from a first position to a second position, said release arm positioned to contact said latch when moved from said first position to said second position and cause said latch to pivot in a predetermined rotational direction; and a reset plate rotating on a third axis, said reset plate mechanically coupled to said release arm and positioned to cause said release arm to pivot in a predetermined rotational direction when said reset plate pivots to a predetermined rotational position, thereby releasing said captured target plate.

2. A target plate rack as claimed in claim 1, wherein said target plate has a distalmost end with respect to said second axis, and wherein said latch is positioned to contact and capture said target plate at or near said distalmost end.

3. A target plate rack as claimed in claim 1, further comprising:

a device mechanically coupled to said target plate and exerting force on said target plate to urge said target plate to pivot toward a second predetermined rotational position.

4. A target plate rack as claimed in claim 3, wherein said device is a spring under tension, and further comprising an adjustment mechanism for altering the tension of said spring.

5. A target plate rack as claimed in claim 1, wherein said third axis is substantially coaxial with said second axis.

6. A target plate rack as claimed in claim 1, wherein at least a portion of at least one of said target plate and said latch comprises armor plating.

7. A target plate rack as claimed in claim 1, further comprising an adjustment mechanism operable to move both (i) said latch and (ii) the location of said second axis on which said latch pivots, forward and rearward to a selected position and to secure said latch at said selected position.

8. A target plate rack as claimed in claim 1, further comprising a device for detecting when said target plate is pivoted to a predetermined rotational position.

9. A target plate rack as claimed in claim 8, further comprising an indicator for indicating said detection by said device that said target plate is pivoted to said predetermined rotational position.

10. A target plate rack as claimed in claim 1, wherein the first axis is different from the third axis.

11. A target plate rack comprising:

at least one latch pivoting on a first axis;

a frame having left and right sides, said frame comprising a plurality of latch mounts aligned on said first axis, each said latch mount positioned to retain one of said latches; and a target plate pivot rod substantially disposed between the left and right sides of said frame, said rod disposed on a second axis;

a release arm pivoting separately from said latch, said release arm:

being mechanically coupled to the left and right sides of said frame, pivoting on a third axis, being movable from a first position to a second position, and being positioned to contact said latch when moved from said first position to said second position and cause said latch to pivot in a predetermined rotational direction; and a reset plate rotating on a fourth axis, said reset plate mechanically coupled to said release arm and positioned to cause said release arm to pivot in a predetermined rotational direction when said reset plate pivots to a predetermined rotational position.

12. A target plate rack as claimed in claim 11, further comprising:

a target plate pivotally disposed on said target plate pivot rod.

13. A target plate rack as claimed in claim 11, further comprising:

at least one leg or leg mount.

14. A target plate rack as claimed in claim 11, further comprising:

a shield comprising armor plating, said shield covering at least a portion of said target plate rack.

15. A target plate rack as claimed in claim 11, further comprising:

at least one device or mating feature formed therein or thereon for coupling said target plate rack to another target plate rack.

16. A target plate rack as claimed in claim 11, wherein at least a portion of at least one of said target plate, said latch, said latch mount and said frame comprises armor plating.

17. A target plate rack as claimed in claim 11, wherein the second axis is different from the fourth axis.

18. A target plate rack comprising:

a target plate pivoting on a first axis; and a latch having first and second ends and pivoting on a second axis between the first and second ends, the first end of the latch having a raised portion with a recess formed thereunder and a beveled surface formed thereon, the second end of the latch having a target-plate contact surface thereon, the latch adapted to capture the target plate in at least two different modes of operation, wherein:

in a first mode of operation, a first portion of the target plate contacts and applies force to the beveled surface of the raised portion of the latch, causing the latch to rotate in a first direction, such that the first portion of the target plate travels along and beyond the beveled surface until the target plate is captured within the recess, and in a second mode of operation, a second portion of the target plate different from the first portion contacts and applies force to the target-plate contact surface of the latch, causing the latch to rotate in a second direction opposite from the first direction until the target plate is captured within the recess.

19. A target plate rack as claimed in claim 18, wherein the latch is adjustable so as to permit varying the distance between the latch and the target plate.

20. A target plate rack comprising:

a plurality of target plates pivoting on a first axis;

a plurality of latches pivoting on a second axis, each latch positioned to contact a respective target plate and capture the target plate when the target plate is pivoted to a first predetermined rotational position; and a reset plate rotating on a third axis different from the first axis, the reset plate mechanically coupled to cause the plurality of latches to release the captured target plates when the reset plate pivots to a predetermined rotational position.

21. A target plate rack comprising:

a plurality of pivoting target plates;

a plurality of latches pivoting independently of one another, each latch positioned to contact a respective target plate and capture the target plate when the target plate is pivoted to a first predetermined rotational position; and a reset plate mechanically coupled to cause the plurality of latches to release the captured target plates when the reset plate pivots to a predetermined rotational position, even if fewer than the entire plurality of target plates have been captured.

* * * * *